US010852116B2

(12) United States Patent
Feda

(10) Patent No.: US 10,852,116 B2
(45) Date of Patent: Dec. 1, 2020

(54) FUZE SETTER INTERFACE FOR POWERING AND PROGRAMMING A FUZE ON A GUIDED PROJECTILE

(71) Applicant: BAE Systems Information and Electronic Systems Integration Inc., Nashua, NH (US)

(72) Inventor: Francis M. Feda, Sudbury, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 65 days.

(21) Appl. No.: 16/294,505

(22) Filed: Mar. 6, 2019

(65) Prior Publication Data

US 2020/0284569 A1 Sep. 10, 2020

(51) Int. Cl.
*F42C 17/04* (2006.01)
*F42C 11/04* (2006.01)
*F42C 11/00* (2006.01)

(52) U.S. Cl.
CPC ..... *F42C 17/04* (2013.01); *F42C 11/001* (2013.01); *F42C 11/04* (2013.01)

(58) Field of Classification Search
CPC ..... F42C 17/04; F42C 11/04; F42C 11/001; H02J 50/10; H02J 50/12; F41A 23/18; F41A 35/00
USPC ..... 89/6, 6.5; 102/212, 215
See application file for complete search history.

(56) References Cited

U.S. PATENT DOCUMENTS 5,109,185 A 4/1992 Ball
5,497,704 A 3/1996 Kurschner et al.
6,268,785 B1 * 7/2001 Kollman ..... F42C 15/40 336/212
6,557,450 B1 5/2003 Cox et al.
7,698,983 B1 4/2010 Pinto et al.
(Continued)

FOREIGN PATENT DOCUMENTS

EP 3097380 11/2016
WO 2018146457 8/2018

OTHER PUBLICATIONS

International Search Report, PCT/US20/20798, dated Jun. 10, 2020, 11 pages.

*Primary Examiner* — Michael D David
(74) *Attorney, Agent, or Firm* — Sand, Sebolt & Wernow LPA; Scott J. Asmus

(57) ABSTRACT

A fuze setter interface for substantially simultaneously and wirelessly transferring power and data between a fuze setter and fuze. The fuze setter interface includes separate power and communications interfaces. In the power interface, an induction coil is provided in each of the fuze setter and fuze. Power is transferred by magnetic field coupling between the induction coils. In the communications interface, a communications member is provided in each of the fuze setter and fuze, along with appropriate functions to generate alternating-current (AC) waveforms, and condition, modulate or demodulate signals. In one example, both communications members are induction coils that transfer data by magnetic field coupling. In another example, both communications members are radio-frequency (RF) transceivers that transfer data by radio signal. The RF transceiver in the fuze may be a Height of Burst (HoB) sensor. In another example, both communications members are optical transceivers that transfer data by optical signal.

20 Claims, 18 Drawing Sheets

(56) References Cited

U.S. PATENT DOCUMENTS

| | | | | |
|---|---|---|---|---|
| 9,472,971 | B2 | 10/2016 | Soar | |
| 2005/0061191 | A1* | 3/2005 | Dietrich | F42C 17/04 102/215 |
| 2005/0126379 | A1 | 6/2005 | Pikus et al. | |
| 2009/0217836 | A1 | 9/2009 | Dietrich et al. | |

* cited by examiner

FUZE SETTER INTERFACE FOR POWERING AND PROGRAMMING A FUZE ON A GUIDED PROJECTILE

BACKGROUND

Technical Field

The present disclosure is directed to fuzes. More particularly, the present disclosure relates to fuze setting systems for fuzes. Specifically, the present disclosure relates to a fuze setter interface that includes a wireless communications interface which enables high speed bidirectional communication between a fuze setter and a fuze, and a wireless electrical power interface for transferring power from the fuze setter to the fuze.

Background Information

Artillery fuzes are typically attached to a leading end of an artillery projectile prior to launch from a gun platform. Next generation artillery fuzes provide guidance capability that may correct for firing errors and steer the projectile to a desired target impact point. The artillery projectile with attached fuze may be loaded into the gun either manually or through use of an automatic loader (autoloader) mechanism.

Fuze setting is the process of quickly programming targeting and other data into artillery fuzes such as those with precision guidance capability. Fuze setting has to occur prior to launch and is typically accomplished by engaging the fuze with a fuze setter. The fuze setter may be part of an autoloader system used to automatically load artillery projectiles into a gun platform while minimizing the need for operator intervention.

In currently known systems, the fuze setter interface may be implemented either as a low speed inductive interface or a high speed direct-connect electrical interface. The low speed inductive interface is a wireless, inductively-coupled interface for both power transfer and data communications. However, typical interfaces are too slow to transfer the amount of data necessary for projectile fuzes utilizing precision guidance kit capabilities in the short time available for the fuze setting process prior to launch.

In direct connect fuze setters, the fuze setter typically utilizes an electrical interface with a direct electrical connection between a connector on the fuze and a mating connector on the fuze setter. The fuze is attached to the end of the projectile and the fuze setter is attached to the fuze to permit fuze setting. In some instances the fuze may be hard mounted to the projectile, and in others, the fuze may be rotationally decoupled from the projectile body allowing it to freely spin relative to the projectile. When the fuze setter is attached to the fuze, the fuze setter connector may generally be misaligned to the fuze. The fuze setter electrical interface may be part of an autoloader, or it may be part of stand-alone fuze setting equipment when an autoloader is not used. Initially, the fuze electrical contacts may be misaligned to the corresponding contacts on the fuze setter. This rotational misalignment may create difficulties during fuze setting since the fuze connector must be rotationally aligned to the mating fuze setter connector in order to establish an electrical connection. The need for an autoloader to perform rotational alignment prior to fuze setting adds complexity into both the autoloader design and operation. This complexity can decrease the reliability and increase the cost of the autoloader. Additionally, the need to rotationally align the fuze increases the overall time required for fuze setting because the time required for alignment must be included. This increase in the overall time due to the rotational alignment results in an undesired decrease in the maximum rate of fire capability of the gun platform.

The high speed direct-connect electrical interfaces are capable of supporting both electrical power transfer and high speed data communications sufficient to support fuze setting or fuze programming. However, an interface utilizing direct electrical connection (i.e., a hard-wire connection) can be difficult to implement and complex to operate as discussed above. Orientation of the fuze relative to the fuze setter may be required in order to align the fuze setter interface connector to that of the fuze. Further, reliability of the interface can be impacted by electrical contact wear and corrosion, and contamination (e.g. dirt) getting into the interface.

SUMMARY

The present disclosure is directed to a high reliability interface between a fuze setter and a fuze, i.e., fuze setter interface that is capable of supporting high speed bidirectional data communications between the fuze setter and the fuze as well as electrical power transfer from the fuze setter to the fuze. This interface is comprised of a communications interface and a power transfer interface. In all embodiments disclosed herein, the communications interface is wireless. The power transfer interface is wireless in some embodiments (inductively coupled), and is a wired, direct connect interface in other embodiments. The fuze setter interface and system disclosed herein address and overcome some of the problems with previously known interfaces and systems.

Since fuzes require large amounts of data to be programmed in a short time, the interface disclosed herein between the fuze setter and the fuze (i.e., the fuze setter interface) is a high speed communications interface. Furthermore, the disclosed fuze setter interface supports electrical power transfer from the fuze setter to the fuze sufficient to operate the fuze. The disclosed fuze setter interface also supports bidirectional communication between the fuze setter and the fuze for programming targeting data and other information into the fuze. Furthermore, the disclosed fuze setter interface is compatible with artillery launch platforms and processes that support manual and/or automatic loading of an artillery projectile into the gun.

The wireless fuze setter interface disclosed herein is comprised of two elements, namely, a communications interface and an electrical power interface. The communications interface supports high-speed, bidirectional data communications between the fuze setter and the fuze and allows for rapid programming of targeting and other data into an artillery fuze with precision guidance capability. The electrical power interface supports transfer of electrical power from the fuze setter to the fuze at levels sufficient for proper fuze operation.

A primary objective of the present disclosure is the implementation of a fully wireless fuze setter interface that includes a communications interface and an electrical power interface. The communications interface is a fully wireless interface, implemented using one or more of any of the following technologies in various embodiments, high speed inductive communications, radio frequency (RF) wireless communications and optical communications. The electrical power interface is a fully wireless, inductively-coupled interface supporting electrical power transfer from the fuze setter to the fuze.

A secondary objective of the present disclosure is the implementation of a fuze setter interface comprised of a fully wireless communications interface and a direct-connect (i.e., hard-wired) electrical power interface.

The constraints in the presently disclosed fuze setter interface and system are, for the communications interface, high speed wireless interface for bidirectional communication between the fuze setter and fuze; high speed interface to reduce fuze set/programming time; allows for rapid programming of fuze setting data and other information during the fuze setting process; and data encryption to maintain security across the interface. The wireless interface has a higher reliability in comparison to alternative interfaces that rely on direct electrical (hard-wired) connection because the wireless interface avoids dependence on electrical contacts for power or signal transfer; is less susceptible to contact wear, corrosion, dirt, contamination, etc. as was experienced by previously known electrical contacts, little to no potential for damaged or broken connectors that typically would occur when operating in harsh environments. Additional benefits of the wireless interface are that there are no exposed conductors since all interface components are contained under the exterior wall of a radome of the fuze. The radome is a housing that forms the tip of the fuze and is used to cover and protect components within the fuze while having an exterior form factor of a suitable aerodynamic shape. The radome housing may be transparent to radar emissions from a Height of Burst (HoB) sensor that may be located within the fuze and covered by the radome housing. The radome housing is suitable for the fuze components for the wireless interface disclosed herein as the radome housing may offer some protection against the ambient environment including but not limited to weather, dust, dirt, water, and other contaminants.

As compared to direct-connect interfaces, the wireless interface may have less susceptibility to the effects of electromagnetic interference (EMI) due to the lack of exposed metallic contacts.

The wireless interface allows for communication through a sealed storage/packaging container in which the fuze may be stored, avoiding the need to remove the fuze from the container.

Additionally, in most embodiments, the interface helps to maintain the aerodynamic profile of the fuze because the interface components are all located within the fuze.

The presently disclosed fuze setter interface is intended to be compatible with fuze setting operations while operating in either of a manual fuze setting environment or in an autoloader environment, when programming an artillery fuze with precision guidance capability. (It will be understood that when a fuze is referred to herein with respect to the disclosed fuze setter interface and system incorporating the same, the fuze in question is an artillery fuze with precision guidance capability. The present system does not require that the fuze be rotationally oriented to the fuze setter and provides a way to allow the fuze and fuze setter to communicate even when the rotational orientation of the fuze relative to the fuze setter is unknown. This applies both to fuzes that may be rotationally coupled (hard mounted) to a projectile body in an unknown rotation orientation. It also applied to fuzes that may be rotationally decoupled from the projectile body due to the presence of bearings between the fuze body and projectile body that are used to allow a portion of the fuze to rotate relative to the projectile body.

Additionally, the fuze setter interface as disclosed makes it possible to rapidly program a fuze in a time of less than about five seconds in a typical environment. The fuze setter interface as disclosed herein is capable of being used, irrespective of whether or not there is an auxiliary mechanism for rotating a fuze into a preferred orientation incorporated into an autoloader. The disclosed fuze setter interface is also compatible with manual fuze setting operations. Additionally, the fuze side of the programming interface is compatible with high gravitational force (high-G) launch environments and the interface does not affect aerodynamic behavior of the guided projectile. The fuze side of the programming interface of the present disclosure tends not to affect or be affected by electromagnetic signals transmitted from the fuze (e.g. by height of burst sensor radar, telemetry, Global Positioning System (GPS), or by other electromagnetic signals that may be present in the ambient environment).

The fuze programming interface as disclosed herein may also compatible with reprogramming while in a storage container when the fuze setter interface is one of the fully wireless embodiments disclosed later herein, and when the storage container is designed to be compatible with the fuze setting interface. In one embodiment described below, the communications interface is wireless, but the power transfer interface is not. Instead, the power transfer interface is a direct-connect, wired interface. In this instance either the fuze will need to be removed from the packaging container to allow the fuze to be powered, or the packaging container will need to be of a type designed to allow the fuze to be powered through the packaging container.

The present disclosure is directed to fuze setter interface for simultaneously and wirelessly transferring power and data between a fuze setter and a fuze and a method of using the same to program and power a fuze on a guided projectile. The fuze setter interface includes a separate power interface and communications interface. In the power interface, an induction coil is provided in each of the fuze setter and fuze. Power is transferred by magnetic field coupling between the induction coils. In the communications interface, a communications member is provided in each of the fuze setter and fuze, along with appropriate functions to generate alternating-current (AC) waveforms, and condition, modulate or demodulate signals. In one example, both communications members are induction coils that transfer data by magnetic field coupling. In another example, both communications members are radio-frequency (RF) transceivers that transfer data by radio signal. The RF transceiver in the fuze may be a Height of Burst (HoB) sensor. A HoB sensor is typically a radar sensor) that is used to sense the height of the projectile above the ground. In another example, both communications members are optical transceivers that transfer data by optical signal.

In one aspect, the present disclosure may provide a system for programming and powering an artillery fuze comprising a fuze setter; a fuze configured to be received in a port of the fuze setter; a data communications interface formed between the fuze setter and fuze; and an electrical power interface formed between the fuze setter and the fuze, wherein the data communications interface and the electrical power interface are configured for substantially simultaneous operation.

In one example, the data communications interface is a fully wireless interface. In one example, the data communications interface enables bidirectional data communications between the fuze setter and the fuze. In one example, the data communications interface utilizes one of inductive communications, wireless radio frequency communications, and optical communications.

In one example, the electrical power interface is fully wireless. In one example, the electrical power interface is an inductively-coupled interface supporting electrical power transfer from the fuze setter to the fuze. In another example, the electrical power interface is a direct-connect interface supporting electrical power transfer from the fuze setter to the fuze.

In one example, the electrical power interface is an independent interface that is separated from the data communications interface. In one example, the data communications interface is comprised of a first communication member located entirely within an interior cavity of the fuze and a second communication member located entirely within an interior cavity (or port) of the fuze setter; wherein a location of the first communication member and a location of the second communication member are complementary such that when the fuze is received in the interior cavity (or port) of the fuze setter, the first communication member and the second communication member are capable of communicating with each other. In other words, the fuze and fuze setter are in sufficiently close enough proximity for a wireless signal generated by one of the fuze and fuze setter to be detected by the other of the fuze and fuze setter.

In one example, both of the first communication member and the second communication member are one of an induction coil, a radio-frequency (RF) transceiver, and an optical transceiver. In another example, both of the first communication member and the second communication member are RF transceivers, and the RF transceiver in the first communication member is a Height of Burst (HoB) sensor. In one example, the first communication member is located within a radome housing of the fuze.

In another aspect, the present disclosure may provide a fuze setter interface for transferring power and data between a fuze setter and a fuze comprising a fuze setter power inductor located within a fuze setter; a fuze setter data communications member located within the fuze setter; a fuze power inductor located within a fuze; and a fuze data communications member located with the fuze; wherein the fuze setter power inductor and the fuze setter data communications member are located within the fuze setter adjacent to a port and will permit substantially simultaneous communication with the fuze power inductor and the fuze data communications member, respectively, when the fuze is inserted into the port.

In one example, both of the fuze setter data communications member and the fuze data communications member are one of an induction coil, a radio-frequency (RF) transceiver, and an optical transceiver.

In one example, the fuze setter power inductor and fuze power inductor form a wireless power interface; and the fuze setter data communications member and fuze data communications member form a wireless data communication interface; and both of the wireless power interface and the wireless data communication interface operate simultaneously.

In another aspect, the present disclosure may provide a method of performing a fuze setting operation on a guided projectile prior to launch, said method comprising inserting a leading end of a fuze of a guided projectile into a port of a fuze setter; forming an electrical power interface between the fuze and the fuze setter; forming a data communications interface between the fuze and the fuze setter; transferring electrical power from the fuze setter to the fuze utilizing the electrical power interface; transferring data between the fuze and the fuze setter utilizing the data communications interface; and wherein the transferring of electrical power and the transferring of data occurs essentially simultaneously.

In one example, the transferring of electrical power and the transferring of data occurs wirelessly. In one example, the forming of the electrical power interface comprises inputting current to an alternating current (AC) waveform generating function of the fuze setter; generating an alternating current (AC) waveform with the AC waveform generating function; inputting the generated AC waveform to a fuze setter power inductor; generating a magnetic field with the fuze setter power inductor; coupling to the magnetic field with a fuze power inductor; generating an AC power waveform output in response to the coupled magnetic field; inputting the AC power waveform output into a power conditioning function in the fuze; and converting the AC power waveform output to useable fuze power. In one method, the forming of the data communications interface comprises forming a bidirectional data communications interface and using the bidirectional data communications interface to transmit data from the fuze setter to the fuze and to transmit data from the fuze to the fuze setter.

In one method, the forming of the data communications interface comprises inputting a data signal to a signal conditioning function of the fuze setter; processing the input data signal to a form a transmission signal compatible with a fuze setter communication member; transmitting the transmission signal from the fuze setter data communication member to a fuse communication member; demodulating the transmission signal; extracting data from the demodulated transmission signal; and wherein the fuze utilizes the extracted data.

In one example, the step of processing of the input data signal through to the step of demodulating of the transmission signal includes generating an alternating current (AC) waveform that is modulated by the data to be communicated across the interface; inputting the generated AC waveform to a fuze setter communications inductor; generating a magnetic field with the fuze setter communications inductor; coupling to the magnetic field with a fuze communications inductor; generating an AC communications waveform output in response to the coupled magnetic field; and inputting the AC communications waveform into a signal conditioning function in the fuze that extracts the data.

In one example, the forming of the data communications interface includes inputting a fuze data signal to a signal conditioning function; developing an AC waveform based on a frequency of a clock oscillator input; modulating the developed AC waveform with the input fuze data signal; applying the modulated AC waveform into a fuze signal inductor; generating a magnetic field with the fuze signal inductor; coupling the fuze signal inductor to a fuze setter inductor utilizing the generated magnetic field; and transferring data to the fuze setter via the magnetic field coupling.

In another example, the step of processing the input data signal comprises processing the input data signal to a form compatible with transmission from a radio-frequency (RF) transceiver; and the step of transmission includes transmitting an RF signal from an RF transceiver in the fuze setter to an RF transceiver in the fuze and vice versa. In another example, the step of processing the input data signal comprises processing the input data signal to a form compatible with transmission from an optical transceiver; and the step of transmission includes transmitting an optical signal from an optical transceiver in the fuze setter to an optical transceiver in the fuze and vice versa.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
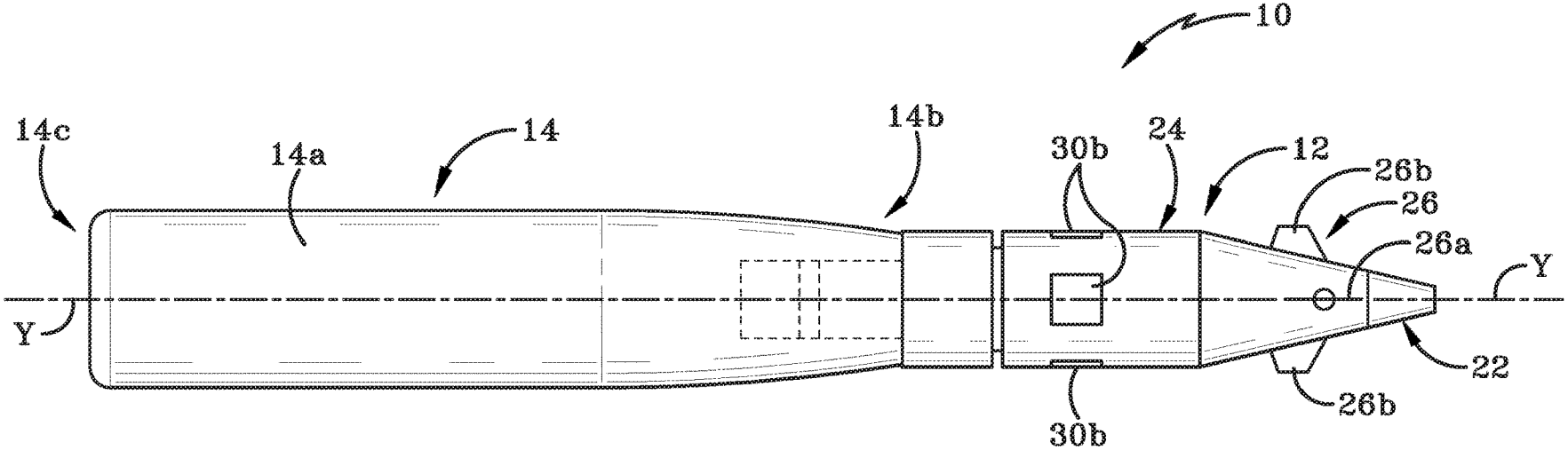
FIG. 1 is a diagrammatic side elevation view of a guided projectile in accordance with an aspect of the present disclosure.

Referring to FIGS. 1 to 4, an exemplary guided projectile is illustrated and is generally indicated by the reference number 10. FIGS. 1-4 further illustrate a fuze setting system configured in accordance with an example of the present disclosure. As will be described hereafter, the fuze setting system includes the fuze 12 provided on guided projectile 10 and a fuze setter station that is configured to engage at least a leading end of the fuze 12.

Guided projectile 10 comprises the fuze 12 operatively coupled with a projectile body 14. Fuze 12 is configured to house a plurality of components utilized to guide the projectile 10 to a remote target 16 (FIG. 3) after being launched from a gun 18, for example. Gun 18 is illustrated as being representative of any type of launch assembly. The components within fuze 12 may utilize data provided by one or more GPS satellites 20 to help guide projectile 10 to the remote target 16. Fuze 12 may further house components that detonate the guided projectile 10 at an appropriate time and/or location when projectile 10 reaches the vicinity of target 16.

Preparation for launch of an artillery projectile, such as guided projectile 10, includes programming data into an artillery fuze with precision guidance capability, such as fuze 12, such that the programming process is compatible with both manually performed and autoloader operations and associated equipment. The programming of the data into the artillery fuze must be done quickly to maintain a maximum rate of fire for the gun platform 18 to which an autoloader may be affixed. The fuze is attached to the tip of a projectile body and typically positioned in the autoloader in an arbitrary rotational orientation. This leads to rotationally misaligning the location of the electrical contact pads on the fuze to mating electrical contacts on the fuze setter side of the interface on the autoloader. This condition may be exacerbated in some applications whereby the fuze itself may be rotationally decoupled from the projectile body, allowing it to spin freely relative to the projectile. In other applications, the fuze is hard mounted to the projectile body so that it does not rotate independently. However, the entire projectile and fuze assembly may be positioned in the autoloader such that it is rotationally misaligned to the fuze setter connector on the autoloader.

This rotational misalignment creates a difficulty during fuze setting since an external connector located on the exterior of the fuze must be rotationally aligned to the mating connector on the fuze setter in order to make the necessary electrical connections prior to initiating the fuze setting process. This need for rotational alignment adds complexity into the design and operation of an autoloader that incorporates fuze setting capability in that either manual intervention, or a rotation mechanism incorporated into the autoloader may be necessary to perform this rotational orientation. This complexity can decrease the reliability and increase the cost of the autoloader. Additionally, the cycle time required for rotational alignment and fuze programming must be included in the overall timeline for fuze setting prior to launch. The increase in time necessary to rotationally orient the fuze can increase the overall time required to prepare and program the fuze prior to launch. This increased time can degrade the maximum rate of fire of the gun platform and impacts operational effectiveness. The present disclosure recognizes there is a need for direct electrical connections between the fuze setter and the fuze that do not require rotational alignment of the fuze.

Figure 2:
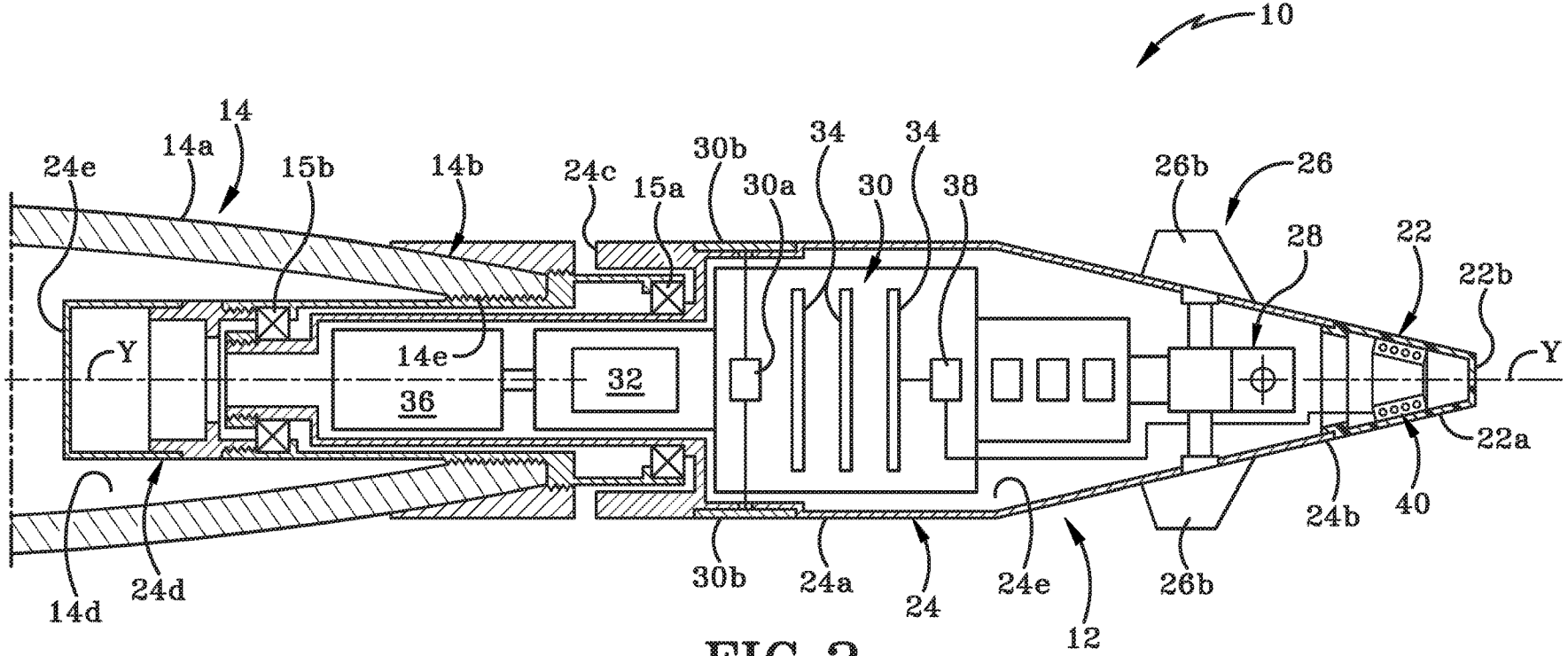
FIG. 2 is a longitudinal cross-section through a front end of the guided projectile of FIG. 1.

Referring to FIGS. 1-4, projectile body 14 may take any of a variety of different forms and may include an exterior wall 14*a* having a first end 14*b* (FIG. 2) and a second end 14*c* (FIG. 1). Wall 14*a* bounds and defines an interior cavity 14*d* and may be fabricated from a material, such as metal, that is structurally sufficient to enable projectile 10 to carry an explosive charge in interior cavity 14*d*. A coupling region 14*e* may be provided proximate first end 14*b* of projectile body 14 and is utilized to engage projectile body 14 and fuze 12 together. A pair of roll bearings 15*a*, 15*b* is provided that allow the fuze 12 to rotate (roll) relative to the projectile body 14. FIG. 2 shows forward roll bearing 15*a* and rear roll bearing 15*b*.

Figure 5A:
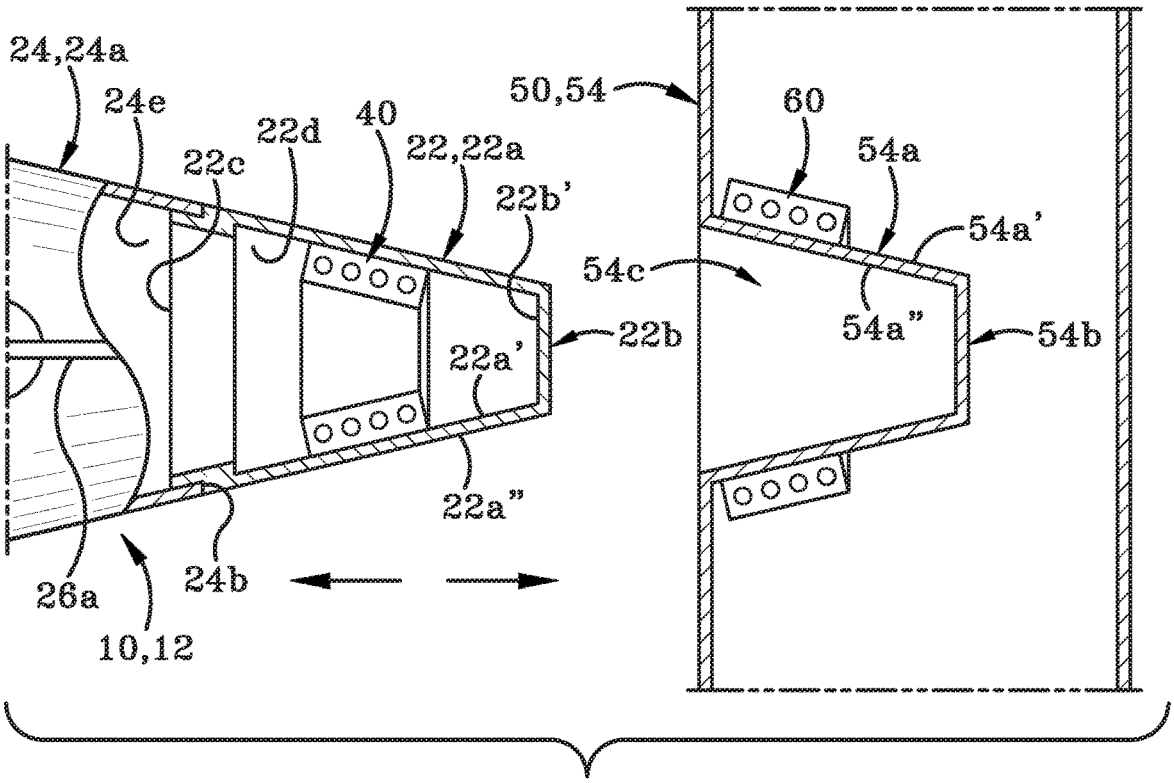
FIG. 5A is a cross-section showing a front end of the guided projectile located proximate the fuze setter and showing a first embodiment of a mechanism for providing high speed data and power to the guided projectile from the fuze setter.

FIGS. 1-5A further illustrate that fuze 12 includes a radome housing 22 and a fuze body 24 that are operatively engaged with each other. Radome housing 22 includes an exterior sidewall 22*a* that may be generally of a truncated conical shape. Radome housing 22 may further include a front end 22*b* and a rear end 22*c* (FIG. 5A). Sidewall 22*a* and front end 22*b* bound and define an interior cavity 22*d* within which various components may be housed. Radome housing 22 forms the nose or leading end of fuze 12 and therefore of guided projectile 10.

As shown in FIG. 2, fuze body 24 includes an exterior sidewall 24*a* having a first end 24*b* (FIG. 2), an intermediate region 24*c*, and an extension 24*d* that extends rearwardly from intermediate region 24*c*. Extension 24*d* is of a smaller circumference than sidewall 24*a* and is adapted to be received within cavity 14*d* of projectile body 14. Sidewall 24*a* bounds and defines an interior cavity 24*e* within which a number of components are housed. Intermediate region 24*c* terminates in a second end that is remote from first end 24*b*. Fuze 12 has a longitudinal axis "Y" that extends between a central region of front end 22*b* and a central region of the second end of fuze body 24. Front wall 22*b* of radome housing 22 may be oriented generally at right angles to longitudinal axis "Y".

First end 24*b* of fuze body 24 may be operatively engaged with rear end 22*c* of radome housing 22 or may be integrally formed therewith. Extension 24*d* of fuze body 24 may be coupled to coupling region 14*e* of projectile body 14. A space may be defined between intermediate region 24*c* of fuze body 24 and a portion of coupling region 14*e* on projectile body 14. Extension 24*d*, which may be tubular in configuration, may be threadedly engaged with coupling region 14*e*. The engagement between fuze 12 and projectile body 14 may be one that permits a portion of fuze 12 to rotate relative to projectile body 14 and about longitudinal axis "Y". Referring to FIG. 2 a rear portion of the fuze 12 is screwed into coupling region 14*e* of fuze body 14. The threads on the fuze side are part of a mechanical component that attaches to the outer races of roll bearings 15*a*, 15*b*. Thus, this rear part of the fuze 12 rotates with the projectile body 14. The roll-decoupled front portion of the fuze 12 (including intermediate region 24*c* and everything attached to it) is attached to the inner races of roll bearings 15*a*, 15*b*. Because of the roll bearings, the forward portion of the fuze 12 is free to rotate relative to the rear portion of the fuze 12 that is screwed into the projectile body 14.

Referring still to FIGS. 1 and 2, a canard assembly 26 may be provided on fuze body 24. Canard assembly 26 may include one or more lift canards 26*a* and one or more roll canards 26*b*. Canards 26*a*, 26*b* are utilized to provide stability and/or control to guided projectile 10 and are operatively engaged with a control actuation system 28 located within interior cavity 24*e* of fuze body 24. Canards 26*a*, 26*b* are operated by control actuation system 28 to steer projectile 10 during its flight towards a remote target 16 (FIG. 3).

Figure 3:
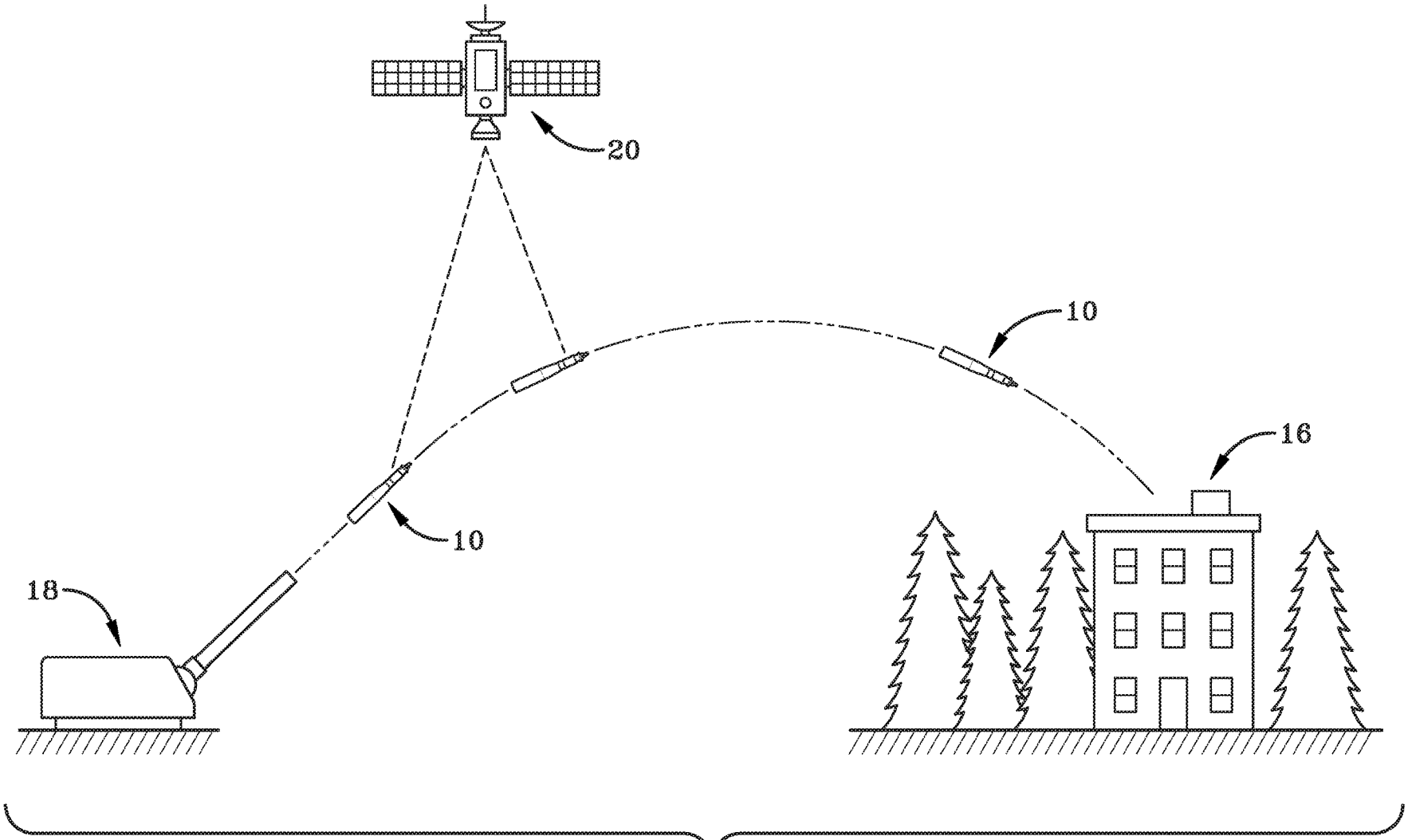
FIG. 3 is a diagrammatic view of the guided projectile being fired from a gun and being directed toward a remote target.
Figure 4:
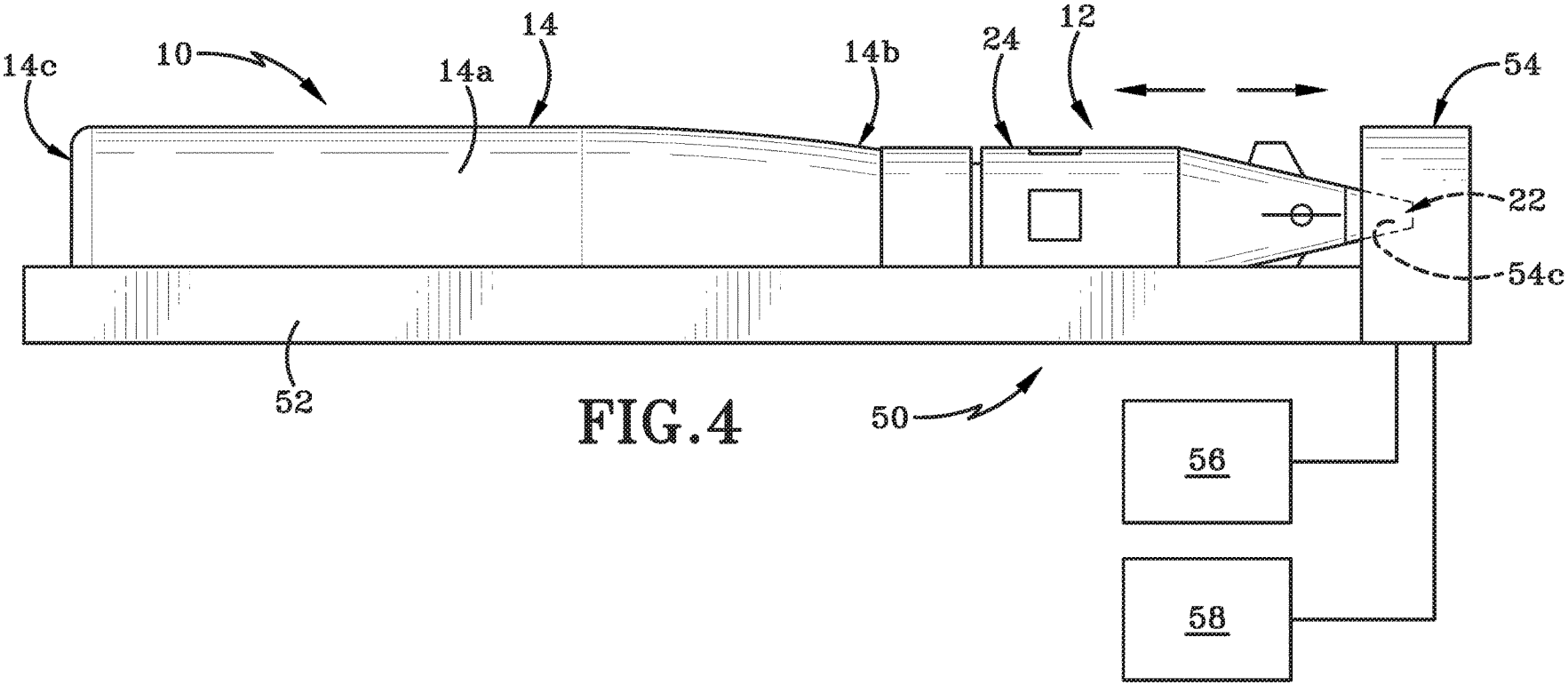
FIG. 4 is a diagrammatic side elevation view of the guided projectile being engaged with a fuze setter.

Referring still to FIG. 3, fuze 12 may further include a guidance, navigation, and control (GNC) assembly 30 located within cavity 24*e*. GNC assembly 30 may comprise a Global Positioning System (GPS) receiver 30*a* and other components as necessary to navigate and guide the projectile 10 to the location programmed during fuze setting. At least one GPS antenna 30*b* is provided on the exterior surface of sidewall 24*a*. Although not specifically illustrated herein, GNC assembly 30 may also include a plurality of other sensors, including, but not limited to, laser guided sensors, electro-optical sensors, imaging sensors, inertial navigation systems (INS), inertial measurement units (IMU), or any other sensors suitable or necessary for use on a guided projectile 10. These sensors may be provided in cavity 22*d* of radome housing 22 or in cavity 24*e* of fuze body 24. These sensors may be provided in cavity 22*d* of radome housing 22 or cavity 24*e* of fuze body 24. It may require large amounts of data to configure the fuze 12 for proper operation during flight. The amount of time available to program fuze 12 prior to launch is generally quite short (a few seconds). This drives the need for a high speed interface in order to communicate the required data to fuze 12 in the short time available.

At least one non-transitory computer-readable storage medium 32, and at least one processor or microprocessor 34 may be housed within cavity 24*e* of fuze body 24. The storage medium 32 may include instructions encoded thereon (i.e., software) that, when executed by the processor or microprocessor 34, implements various functions and operations to aid in guidance, navigation and control of guided projectile 10. This software is typically programmed as a maintenance operation either at a factory, or at a service depot but microprocessor 34 may, alternatively be programmed using the fuze setter interface disclosed herein. A battery 36 and a fuze power supply 38 may be located within interior cavity 24*e*. Battery 36 may be operatively engaged with any of the aforementioned components that require power to operate.

It will be understood that the placement of the various components within fuze 12 may be different from what is illustrated herein. In some examples, some of the above-mentioned components may be omitted from guided projectile 10. In other examples, additional components may be included in guided projectile 10. Some or all of the components may be operatively engaged with each other via wiring. Only some wiring has been illustrated in FIG. 2 for the sake of clarity of illustration. It will be understood that any type of connections may be provided between the various components within fuze 12.

The present disclosure describes a number of different embodiments. It will be understood that the wiring within the fuze body and the radome housing from one embodiment to another may differ in some aspects simply because different components provided within the radome housing are being operatively engaged with the fuze electronics. Such variations in the wiring will be obvious to those of ordinary skill in the art.

As indicated earlier herein, FIG. 3 depicts the operation of guided projectile 10 when fired from a gun 18 elevated at an angle towards a remote target 16. Target 16 is illustrated as being located at an estimated or nominal distance from the gun 18. It is necessary to provide guided projectile 10 with the coordinates of the target 16 and with other information prior to launch. Additionally, it may be necessary to provide the guided projectile 10 with other data to allow the projectile to be properly guided to the target 16. The present disclosure provides a system and method for quickly and easily uploading the necessary data to guided projectile 10 prior to launch. The data may include data relating to targeting information and other data required for proper operation of fuze 12. The data may be uploaded and stored in storage medium 32 and utilized by microprocessor 34. It is also necessary to provide sufficient power to guided projectile 10 to operate the various components and systems within fuze 12. For example, power may be required to pivot one or more of the canards 26*a*, 26*b* during flight so as to ensure that guided projectile 10 is steered toward target 16.

The data required to direct guided projectile 10 toward the correct target 16 and to properly detonate guided projectile 10, as well as the power to operate the various systems within projectile 10 are provided during the fuze setting operation. FIGS. 1-4 show a guided projectile 10 that is selectively engageable engaged with a fuze setter 50 that all may be located on a gun platform 18 (FIG. 3). Fuze setter 50 may be of any type and configuration but is illustrated diagrammatically herein in FIG. 4 as including an autoloader feed tray 52 and a fuze setter station 54.

Referring again to FIG. 4, a power source 56 is operatively engaged with fuze setter 50. Power source 56 may be internal to fuze setter 50. Alternatively, the power source 56 may be located remote from fuze setter 50 but is operatively engaged therewith by appropriate wiring. Fuze setter 50 further includes computer or central processing unit (CPU) 58 that is programmed to operate fuze setter 50 and is further programmed to provide the desired data to fuze 12 when fuze 12 is engaged with fuze setter 50. CPU 58 may be provided within an interior of fuze setter 50 or may be located remote therefrom and connected to fuze setter 50 in any appropriate way. CPU 58 may be programmed to include various functions that generate, transmit, and/or receive waveforms, magnetic fields, signals, etc., as will be further described herein. Data in CPU 58 that is subsequently transferred to the fuze may be stored within CPU 58 or may be entered into CPU 58 or the system via some type of user interface.

FIGS. 5A through to 11C disclose various embodiments of the components provided in fuze 12 and fuze setter 50 to establish a fuze setter interface for power and data transfer. In each of the different embodiments, one or more components are provided on fuze 12 that interact with one or more components on fuze setter 50. In particular, the components on fuze 12 interact with one or more components on a fuze setter station 54 to transfer electrical power from fuze setter 50 to fuze 12 and to provide bidirectional data communication between fuze setter 50 and fuze 12. As will be disclosed hereafter, there are a number of options for transferring electrical power from fuze setter 50 to fuze 12 and a number of options for transferring data between fuze setter 50 and fuze 12.

Figure 5B:
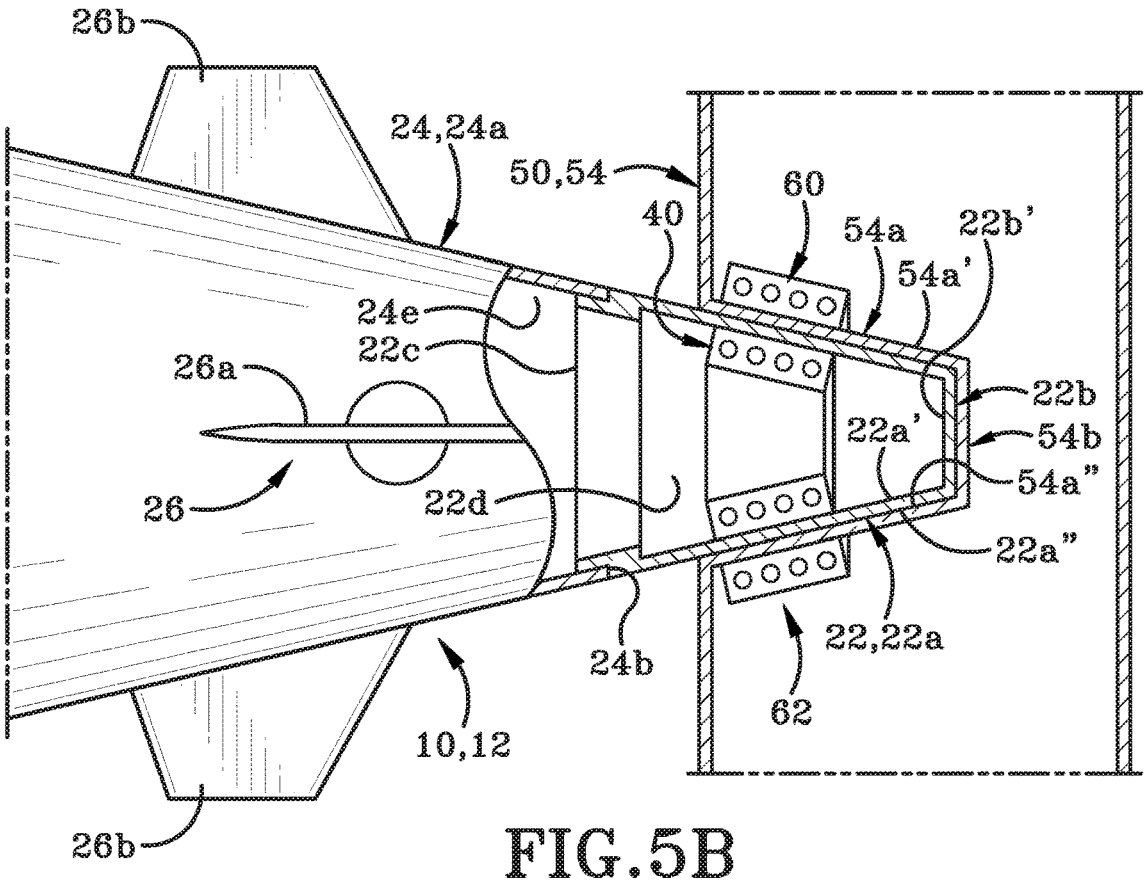
FIG. 5B is a partial cross-section of the front end of the guided projectile of FIG. 5A shown engaged in the fuze setter.
Figure 5C:
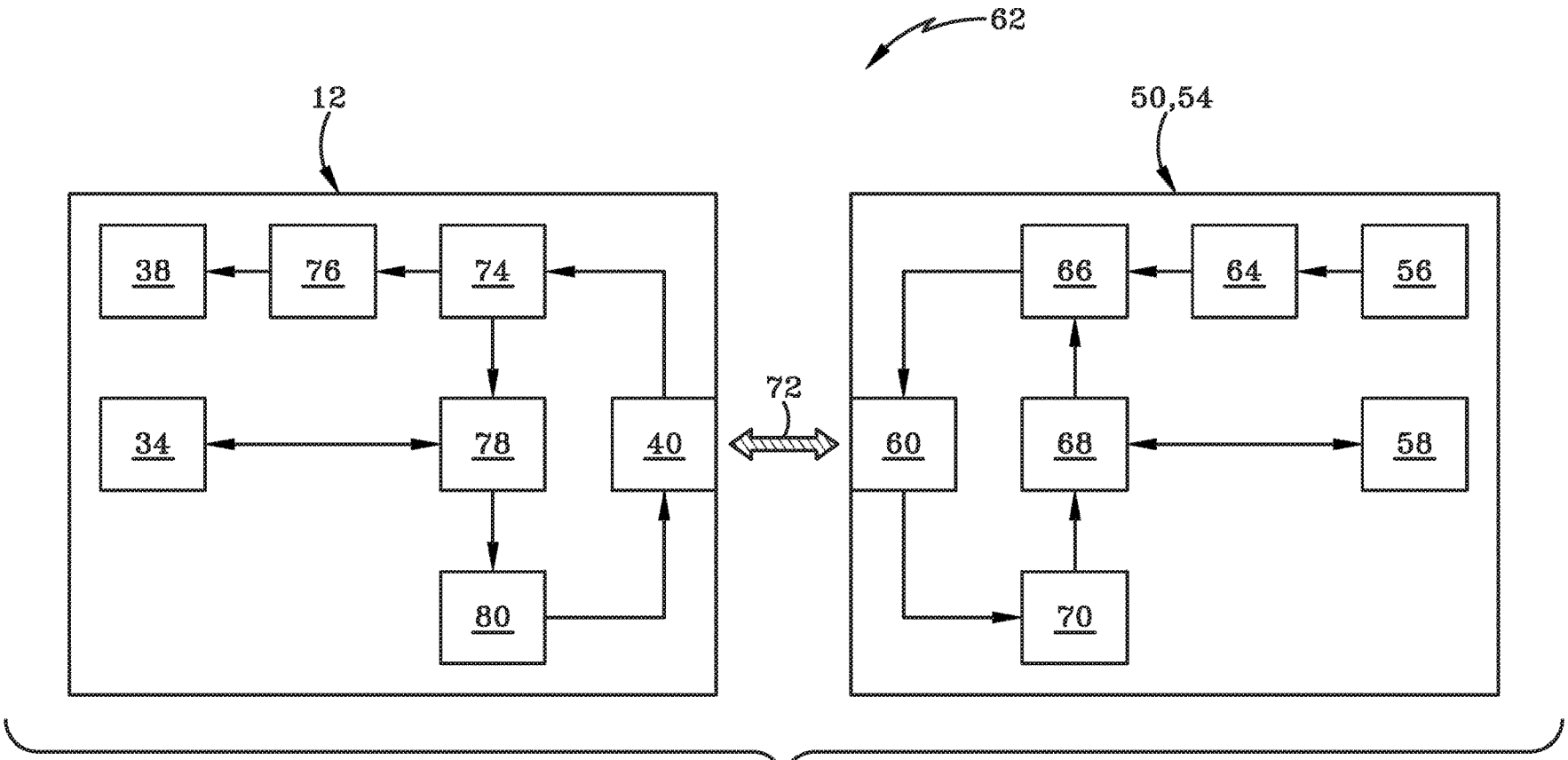
FIG. 5C is a flow chart showing a first method of providing high speed data and power to the guided projectile using the fuze setter.

FIGS. 5A through 5C show a first embodiment of a fuze setter interface in accordance with the present disclosure, generally indicated at 62. (FIG. 5B). It should be understood that FIGS. 5A to 5C are a diagrammatic illustration of the first embodiment fuze setter interface 62. It will further be understood that FIGS. 5A-5B show components relevant to fuze setter interface 62. Other components that may be present in the radome housing 22, fuze body 24 and fuze setter 50 may be omitted for clarity of illustration. Fuze setter interface 62 provides the capability to transfer power to fuze 12 and communicate data bi-directionally between the fuze 12 and fuze setter 50.

Referring to FIGS. 5A and 5B, fuze setter station 54 of fuze 50 includes a sidewall 54*a* that is complementary in shape and size to the sidewall 22*a* of radome housing 22 of fuze 12. Fuze setter station 54 further includes a front wall 54*b* that is complementary in shape and size to front wall 22*b* of radome housing 22. Sidewall 54*a* and front wall 54*b* bound and define a port 54*c* that is complementary to at least a portion of the exterior surface of radome housing 22. When data and power are to be downloaded to fuze 12, a leading region of fuze 12 is introduced into port 54*c* of fuze setter station 54. When the leading region of fuze 12 is introduced into port 54*c*, front end 22*b* of fuze 12 may be located in close proximity to front wall 54*b* and sidewall 22*a* of fuze 12 may be located in close proximity to sidewall 54*a*. In one example, sidewall 22*a* of fuze 22 may abut sidewall 54*a* of fuze setter station 54 and front wall 22*b* of fuze 12 may abut front wall 54*b* of fuze setter station 54. When the leading region of fuze 12 is positioned within port 54*c*, a fuze setter interface is established between fuze 12 and fuze setter 50. Through this fuze setter interface, both electrical power and data, such as targeting data, is transferred to fuze 12 from fuze setter 50.

In the first embodiment, fuze 12 is provided with a fuze induction coil 40. Fuze induction coil 40 is a single coil that is located proximate an interior surface 22*a*' of sidewall 22*a* of radome housing 22. Fuze induction coil 40 may be an annular inductive coil that is positioned inwardly from and adjacent to the interior circumferential surface 22*a*' of sidewall 22*a* of radome housing 22. No part of fuze induction coil 40 extends through sidewall 22*a* to the exterior surface 22*a*". In other words, the sidewall 22*a* is substantially continuous and uninterrupted between front wall 22*b* and rear end 22*c*. Fuze induction coil 40 may be operatively engaged with microprocessor 34, fuze power supply 38, and other components within fuze 12.

In the first embodiment, a fuze setter induction coil 60 is a single coil provided within fuze setting station 54. Fuze setter induction coil 60 may be an annular inductive coil that is positioned outwardly from and adjacent to the interior circumferential surface 54*a*' of sidewall 54*a* of fuze setter station 54. No part of fuze setter induction coil 60 extends through sidewall 54*a* to the exterior surface 54*a*" thereof. The exterior surface 54*a*" of sidewall 54*a* is therefore free of any obstructions or breaks.

Fuze setter induction coil 60 is located within fuze setting station 54 such that when radome housing 22 of fuze 12 is received within port 54, fuze induction coil 40 will be in radial alignment with fuze setter induction coil 60. In other words, fuze setter induction coil 60 is configured as an annular coil that will circumscribe fuze setter induction coil 50 when radome housing 22 of fuze 12 is inserted into port 54*c*. Fuze setter induction coil 60 is therefore in a mating position with respect to fuze induction coil 40 when fuze 12 is received in port 54*c* of fuze setter 50.

Referring to FIG. 5C, fuze setter interface 62 is created when the single fuze induction coil 40 and the single fuze setter induction coil 60 are located in close proximity to each other. Fuze induction coil 40 and fuze setter induction coil 60 do not contact each other. Instead, the exterior surface 22*a*" of fuze 12 is brought into close proximity to exterior surface 54*a*" of fuze setter station 54 in one example. In another example, exterior surface 22*a*" of fuze 12 abuts exterior surface 54*a*" of fuze setter station 54. Fuze setter interface 62 is a single, shared inductive interface that provides for electrical power transfer and for bidirectional communications between fuze 12 and fuze setter station 54. Electrical power may be transferred wirelessly from fuze setter 50 to fuze 12 through fuze setter interface 62. In particular, the wireless transfer may be an inductive transfer of power.

When radome housing 22 is inserted into port 54*c* of fuze setter station 54 there is inductive coupling between fuze induction coil 40 in fuze 12 and the mating fuze setter induction coil 60 in fuze setter 50. FIG. 5C is a flowchart showing how fuze setter interface 62 operates. Fuze setter 50 includes a power source 56, a CPU 58, an AC waveform generator function 64, an AC waveform data modulation function 66, and the fuze setter induction coil 60. Fuze setter 50 further includes CPU 58, a signal conditioning function 68, and a waveform data demodulation function 70. The AC waveform generator function 64, AC waveform data modulation function 66, and signal conditioning function 68 and waveform data demodulation function 70 may all be functions performed by the programming of CPU 58 or by other components designed specifically to perform these functions.

Fuze 12 may include a microprocessor 34, fuze power supply 38, a fuze induction coil 40, an AC waveform data demodulation function 74, an AC to DC power conversion function 76, a signal conditioning function 78, and a waveform data modulation function 80. The AC waveform data demodulation function 74, power conversion function 76, signal conditioning function 78 and waveform data modulation function 80 may all be performed by programming in microprocessor 34 or by other components designed specifically to perform these functions.

Fuze setter 50 provides electrical power to fuze 12 during the fuze setting operation. While AC power may be coupled into fuze 12 via the inductive interface to fuze setter 50, this AC power is converted to DC power in the power conditioning module (effectively an AC-input to DC-output power supply). The fuze power supply 38 may also contain an energy storage capacitor that is charged while fuze setter 50 provides power to fuze 12, and may be used to provide power to the fuze electronics for a limited time after the AC power input to the fuze 12 from fuze setter 50 has been removed. The purpose of the fuze power supply 38 is to collect and store energy during this time, so that when the fuze setter 50 is disconnected, the fuze 12 can remain powered in a low-power state (by the energy in the fuze power supply 38) until the projectile 10 is launched and the main power supply i.e., battery 36 is activated. The fuze is maintained in the low-power state to preserve the fuze setting data that was stored in memory, i.e., in storage medium 32 (FIG. 2) during the fuze setting process and until battery 36 is activated after launch. In one example fuze power supply is a capacitor. In one example, fuze power supply 38 is a battery. It will be understood that any suitable type of fuze power supply may be utilized.

As indicated above, the fuze setter operation includes an electrical power transfer and data communications. In one example, DC current is input from power source 56 (FIG. 4) and is applied to the Alternating Current (AC) waveform generation function 64. In the AC waveform generation function 64, electrical power from DC power source 56 is converted to an AC waveform suitable for driving fuze setter induction coil 60. In other words, an AC waveform is generated in the conversion step. The generated AC waveform is then modulated by the AC waveform data modulation function 66 by the signal which contains the data to be communicated to fuze 12, and the modulated waveform is applied to fuze setter induction coil 60 for transmission to fuze 12. In response to the modulated AC waveform, fuze setter induction coil 60, generates a magnetic field that couples 72 to fuze induction coil 40 on the fuze 12 side of the electrical power interface 62. Electrical power and data are transferred from fuze setter 50 to fuze 12 via this magnetic field coupling 72. The effect of the magnetic field coupling 72 in fuze 12 will be described below. (It will be understood that in other examples, power source 56 may be an AC power source instead of a DC power source.)

With respect to the data communication between fuze setter 50 and fuze 12, communication may operate in either a half-duplex mode or a full-duplex mode. The half-duplex mode allows for bidirectional communication between two stations but not simultaneously. In fuze setting applications, fuze setter 50 functions as the master and fuze 12 as the slave such that fuze 12 only transmits to fuze setter 50 in response to a command from fuze setter 50. Thus, only one of fuze setter 50 and fuze 12 is transmitting at a time. Full-duplex mode allows for substantially simultaneous bidirectional communications between two stations. It should be understood that the terms "essentially simultaneous", "substantially simultaneous", and "simultaneous" are used herein to describe a situation where power transfer and communications operations can occur at the same time. In prior art fuze setters, a single interface was used for both power transfer and communications. This prior art single interface was shared for the two operations and therefore only one of the two operations could occur at a time. In the presently disclosed system, power transfer and communications operations occur independently and there may therefore be moments during the fuze setting process where power is being transferred and communications are idle, or vice versa. However, the presently disclosed system is capable of transferring power and communications concurrently. In some fuze setting applications there is bidirectional communication between fuze setter 50 and fuze 12. In some fuze-setting applications the simultaneous bidirectional communication is unnecessary as half-duplex, i.e., command-response) protocols are used.

The following description of data communication between fuze setter 50 and fuze 12 is applicable to either the half-duplex mode or full-duplex mode of operation. In fuze setter transmit (fuze receive) mode, fuze setter data is input from CPU 58 to signal conditioning function 68. In the signal conditioning function 68, the input data is processed into a form that is compatible with being able to modulate the AC power waveform. This processing may including filtering, gain, offset, and other conditioning of the data, as may be necessary. The output from the signal conditioning function 68 is applied to the input of the AC waveform data modulation function 66 where the AC power waveform is modulated by the data. The modulated AC waveform is then output to the fuze setter 50 by induction coil 60 which then generates the magnetic field.

In fuze setter receive (fuze transmit) mode, a signal received from the fuze setter induction coil 60 is applied to waveform data demodulation function 70 where data is removed from the inductive waveform. The demodulated data is then applied to the signal conditioning function 68. Through the signal conditioning function, the data is converted into a form which may be read and/or interpreted by the CPU 58 of fuze setter 50.

FIG. 5C also shows the operation of fuze 12 in response to the electrical power transfer and the data communication from fuze setter 50 via magnetic field coupling 72. In response to the electrical power transfer, fuze induction coil 40 generates an AC power waveform output in response to the magnetic field coupled to fuze induction coil 40 by fuze setter induction coil 60. The AC power waveform is then input to the AC waveform data demodulation function 74 where the data waveform transmitted by the fuze setter 50 is removed (Data In) for further processing. The AC power waveform is then converted to DC power by the AC to DC power conversion function 76. The DC power output is then applied to fuze power supply 38 of fuze 12 for later use.

With respect to data communication from fuze setter 50 to fuze 12, data input from the fuze setter (fuze data receive) is removed from the AC waveform generated by the fuze induction coil 40 in response to the magnetic field variations induced by the fuze setter 50, via the AC waveform data demodulation function 74. This data is then applied to the signal conditioning function 78 for further processing. This further processing may include filtering, amplification, offset correction etc., and then output to microprocessor 34 of fuze 12 via the data In/Out signal.

Data to be transmitted by fuze 12 to fuze setter 50 is input to the signal conditioning function 78 for any conditioning that may be necessary. The conditioned data is then applied to the waveform data modulation function 80 where the data is used to modulate an AC waveform carrier signal. This AC waveform carrier signal is then applied to the fuze induction coil 40, which couples 72 with fuze setter induction coil 60, exciting the same and producing a corresponding response in the fuze setter induction coil 60. The response in the fuze setter induction coil 60 has been described above.

The downloading of power and data to fuze 12 from fuze setter 50 via the inductive magnetic field coupling may take less than about five seconds. Guided projectile 10 is removed from port 54*c* of fuze setter station 54 and is moved into a position in gun 18 where guided projectile 10 may be launched toward the remote target 16. Another guided projectile (i.e., a "new" guided projectile) may be moved by autoloader feed tray 52 into engagement with fuze setter station 54 so that data and power may be downloaded into the fuze of that new guided projectile in the same manner as described above. The next projectile is programmed in the same manner as the previous projectile, with data relevant to that particular launch event.

While fuze induction coil 40 has been disclosed and illustrated as being located adjacent the interior surface 22*a*' of sidewall 22*a* of radome housing 22, it will be understood that fuze induction coil 40 may, instead, be located adjacent the interior surface 22*b*' of front wall 22*b*. If this is the case, then fuze setter induction coil 60 will be located in a complementary location on fuze setter station 54 to mate with fuze induction coil 40.

Figure 6A:
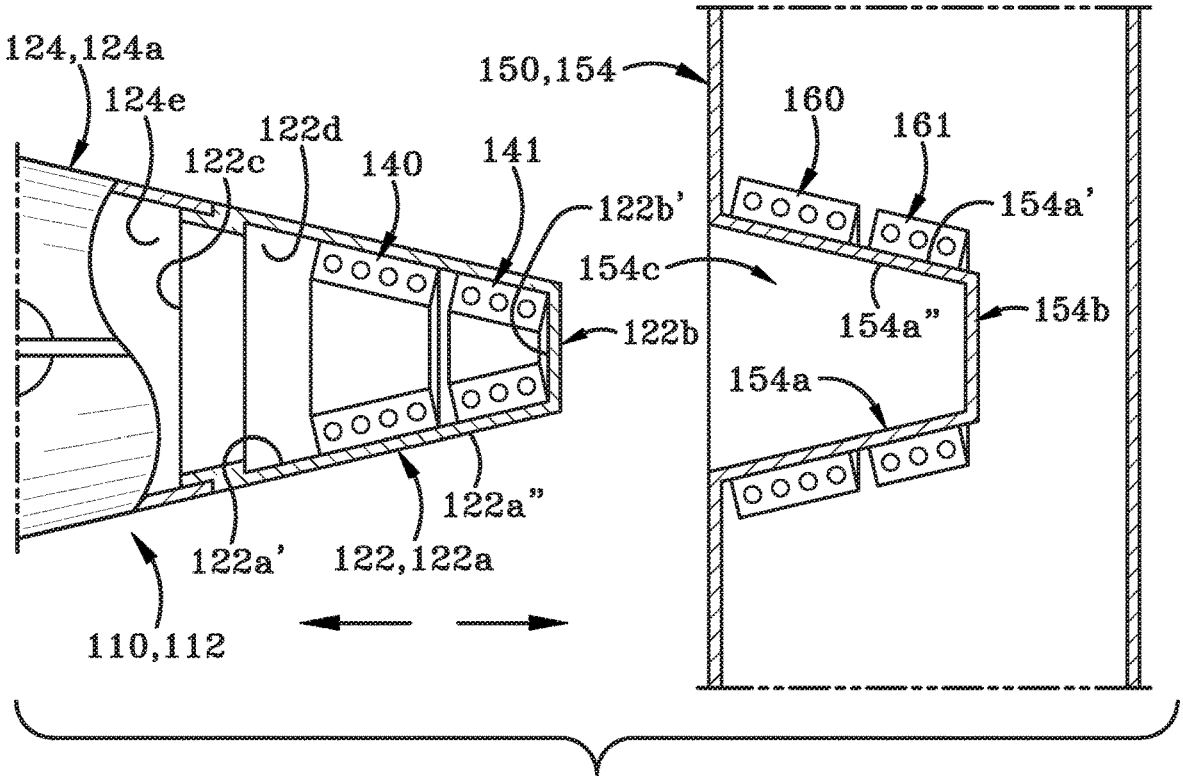
FIG. 6A is a cross-section showing a front end of the guided projectile located proximate the fuze setter and showing a second embodiment of a mechanism for providing high speed data and power to the guided projectile from the fuze setter.
Figure 6B:
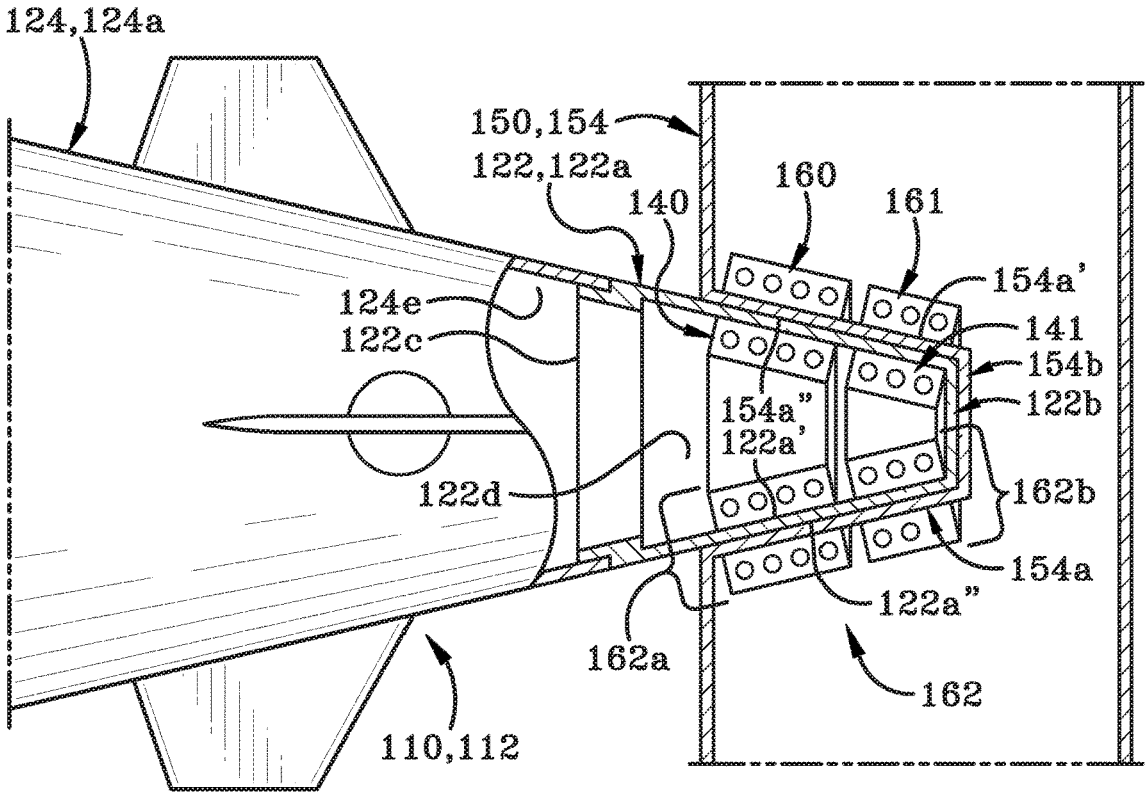
FIG. 6B is a partial cross-section of the front end of the guided projectile of FIG. 6A shown engaged in the fuze setter.
Figure 6C:
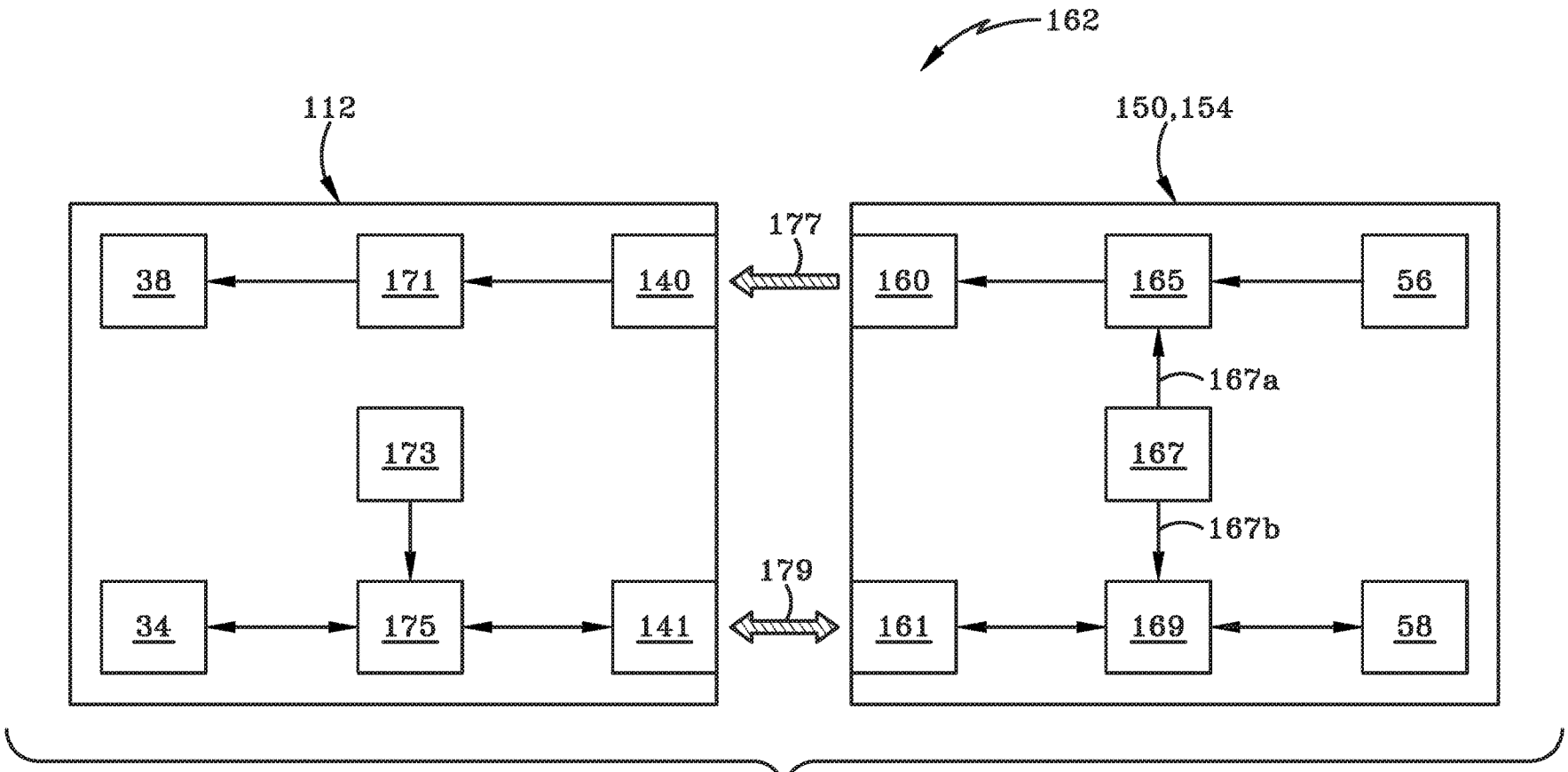
FIG. 6C is a flow chart showing a second method of providing high speed data and power to the guided projectile using the fuze setter.

FIGS. 6A to 6C disclose a second embodiment of fuze setter interface in accordance with the present disclosure, generally indicated as 162 in FIG. 6B. Fuze setter interface 162 provides for high speed data communications between fuze setter 150 and fuze 112. These include but may not be limited to high speed inductive communications. In fuze setter interface 162 an inductively coupled interface is provided that is optimized for high speed communications and is separated from the low speed electrical power interface. The inductively coupled communications interface utilizes a data transfer coil with data superimposed on an AC data transfer waveform. Fuze setter interface 162 is illustrated in FIGS. 6A-6B as comprising an inductive electrical power transfer interface 162*a* and an inductive data communications interface 162*b* that are physically spaced-apart or separated from each other. First interface 162*a* is a high power, low speed interface for efficient electrical power transfer from fuze setter 150 to fuze 112. The second interface 162*b* is a high speed communications interface which allows for high speed, low power inductive coupling for bidirectional data communications between fuze setter 150 and fuze 112.

FIG. 6A shows a leading end of a guided projectile 110 that includes a fuze 112 comprising a radome housing 122 engaged with a fuze body 124. Fuze body 124 is substantially identical to fuze body 24 and includes a sidewall 124*a* that defines an interior cavity 124*e*. The same components are located in cavity 124*e* as are located in cavity 24*e*. Radome housing 122 is substantially identical to radome housing 22 in all aspects except radome housing 122 includes a first fuze induction coil 140 and a second fuze induction coil 141 instead of a single fuze induction coil 40. First fuze induction coil 140 is configured to be capable of electrical power transfer and second fuze induction coil 141 is configured to be capable of high speed communications. For this reason, first fuze induction coil 140 may also be referred to herein as a fuze power inductor 140 and the second fuze induction coil 141 may also be referred to herein as a fuze signal inductor 141.

Fuze power inductor 140 and fuze signal inductor 141 are each configured as an annular inductive coil that is positioned within interior cavity 122*d* of radome housing 122. Fuze power inductor 140 and fuze signal inductor 141 are located inwardly from and adjacent to the interior circumferential surface 122*a*' of sidewall 122*a* of radome housing 122. No part of fuze power inductor 140 or of fuze signal inductor 141 extends through sidewall 122*a* to the exterior surface 122*a*" thereof. In other words, the exterior surface 122*a*" of sidewall 122*a* is substantially continuous and uninterrupted between front wall 122*b* and rear end 122*c*. Fuze power inductor 140 and fuze signal inductor 141 may be longitudinally spaced a distance apart from each other. Either of fuze power inductor 140 and fuze signal inductor 141 may be located closest to front wall 122*b*. Fuze power inductor 140 and fuze signal inductor 141 may share a common lead, in effect being realized as a single, center-tapped coil, with one tap being used for power transfer and the other for bidirectional communications. Fuze power inductor 140 and fuze signal inductor 141 may be operatively engaged with various appropriate components housed within interior cavity 124*e* of fuze body 124, such as the previously described fuze power supply 38 and microprocessor 34.

Fuze setter station 154 may be substantially identical to fuze setter station 54 in all aspects except fuze setter station 154 includes a first fuze setter induction coil 160 and a second fuze setter induction coil 161 instead of the single fuze setter induction coil 60 of fuze setter station 54. First fuze setter induction coil 160 is configured to be capable of electrical power transfer and second fuze setter induction coil 161 is configured to be capable of high speed communications. For these reasons, first fuze setter induction coil 160 may also be referred to herein as fuze setter power inductor 160 and the second fuze setter induction coil 161 may be referred to herein as fuze setter signal inductor 161.

Fuze setter power inductor 160 and fuze setter signal inductor 161 may each be an annular inductive coil that is positioned outwardly from and adjacent to the interior circumferential surface 154*a*' of sidewall 154*a* of fuze setter station 154. No part of fuze setter power inductor 160 or of fuze setter signal inductor 161 may extend through sidewall 154*a* to the exterior surface 154*a*" thereof and into cavity 154*c*. The exterior surface 154*a*" of sidewall 154*a* is therefore free of any obstructions or breaks. Fuze setter power inductor 160 and fuze setter signal inductor 161 may be longitudinally spaced from each other. Fuze setter power inductor 160 is positioned to matingly align with fuze power inductor 140 and fuze setter signal inductor 161 is positioned to matingly align with fuze setter signal inductor 161 when fuze 122 is received in port 154*a*. Each of fuze setter power inductor 160 and fuze setter signal inductor 161 may be configured as annular coils that will circumscribe fuze power inductor 140 and fuze signal inductor 141, respectively, when radome housing 122 of fuze 112 is inserted into port 154*c*. Fuze setter power inductor 160 and fuze setter signal inductor 161 may share a common lead, in effect being realized as a single, center-tapped coil, with one tap being used for power transfer and the other for bidirectional communications.

When radome housing 122 is located in port 154*c* there is inductive coupling between fuze power inductor 140 and fuze setter power inductor 160 and this results in a high power, low speed interface for efficient electrical power transfer from fuze setter station 54 to fuze 112. Additionally, there is inductive coupling between fuze signal inductor 141 and fuze setter signal inductor 161 and this results in a high speed, lower power coupling for bidirectional data communications between fuze setter station 154 and fuze 112.

Referring to FIG. 6C, fuze setter 150, 154 includes a DC power source 56, a CPU 58, a fuze setter power inductor 160, a fuze setter signal inductor 161, an AC waveform generation function 165, a clock oscillation function 167, and a signal conditioning function 169. A first output signal 167*a* from clock oscillation function 167 is used as an input to the AC Waveform Generation function 165. A second output signal 167*b* from the clock oscillation function 167 is used as an input to the Signal Conditioning function 169. AC waveform generation function 165, clock oscillation function 167, and signal conditioning function 169 may be functions performed by the programming of CPU 58 or by other components designed specifically to perform these functions. Fuze 112 includes a microprocessor 34, a fuze power supply 38, a fuze power inductor 140, a fuze signal inductor 141, a power conditioning function 171, a clock oscillator function 173, and a signal conditioning function 175. Power conditioning function 171, clock oscillator function 173, and signal conditioning function 175 may be functions performed by the programming of microprocessor 34 or by other components designed specifically to perform these functions.

As indicated above, the fuze setter operation includes an electrical power transfer and a data communication. In the electrical power transfer, the fuze setter DC power source 56 is input or applied to the AC waveform generation function 165 of the fuze setter station 154. In the AC waveform generation function 165, the DC power is converted to an AC waveform suitable for driving the fuze setter power inductor 160. The AC waveform is then applied to the fuze setter power inductor 160. In response to the applied AC waveform, the fuze setter power inductor 160 generates a magnetic field that couples 177 to the fuze power inductor 140 on the fuze 12 side of the electrical power interface 162*a*. Electrical power is transferred from fuze setter 150 to fuze 112 via this magnetic field coupling 177.

In the data communication side of the fuze setter operation, the communication may operate in a half-duplex mode. In fuze setter transmit (fuze receive) mode, the fuze setter data is input from CPU 58 to the signal conditioning function 169 of fuse setter 150. The Clock oscillator 167 generates two output signals. A first output signal 167*a* is used as an input to the AC Waveform Generation function 165. A second output signal 167*b* is used as an input to the Signal Conditioning function 169. The first output signal 167*a* and second output signal 167*b* may be of different frequencies, as determined based on their intended function. The frequency driving the Signal Conditioning function 169, i.e., second output signal 167*b*, will generally be expected to be much higher than the frequency of the first output signal 167*a* that is input to the AC Waveform Generation function 165. Within the signal conditioning function 169, an AC waveform is developed based on the frequency of the second output signal 167*b* from the clock oscillator 167. This AC waveform is modulated by the input data signal. The modulated AC waveform is then applied to the fuze setter signal inductor 161. In response, the fuze setter signal inductor 161 generates a magnetic field 179 that couples to the fuze signal inductor 141 on the fuze 12 side of the communication interface 162*b*. Data is transferred to the fuze 112 from fuze setter 150 via this magnetic field coupling 179.

In fuze setter receive (fuze transmit) mode, a modulated AC waveform developed by the fuze setter signal inductor 161 in response to the magnetic field applied 179 by the fuze signal inductor 141 is input to the signal conditioning function 169. In this function 169, the AC waveform is demodulated and processed (e.g. filtering or amplification) to extract the data content which is then processed and/or stored by the CPU 58.

The input signal to fuze signal inductor 141 is developed in the following way. Microprocessor 34 generates data that is input to signal conditioning function 175. The Clock Oscillator 173 generates a clock output of desired frequency that is also input to Signal Conditioning function 175. The Signal Conditioning function 175 generates an AC waveform output to drive signal inductor 141, such that the frequency of this AC waveform is derived from the input frequency of the signal from clock oscillator 173, and modulated by the data that is input from fuze power supply 38.

In fuze transmit mode, the fuze data is input from microprocessor 34 to the signal conditioning function 175 of fuze 112. Within the signal conditioning function 175, an AC waveform is developed based on the frequency of input from the clock oscillator 173. This AC waveform is modulated by the input data signal. The modulated AC waveform is then applied to the fuze signal inductor 141. In response, the fuze signal inductor 141 generates a magnetic field that couples 179 to the fuze setter signal inductor 161 on the fuze setter side of the communication interface 162*b* (FIG. 6B). The signal inductor 161 generates an AC waveform in response to the magnetic field 171. This AC waveform is then applied as an input to the Signal Conditioning function 169 where the data is extracted from the waveform. The data may then be communicated to the fuze setter CPU 58 for subsequent processing.

FIGS. 6A and 6B show fuze signal inductor 141 and fuze signal inductor 140 being located adjacent interior surface 122*a*' of sidewall 122 of radome housing 122. Fuze signal inductor 141 is located a first distance inwardly from front wall 122*b* and fuze power inductor 140 is located a second distance inwardly from front wall 122*b*, with the second distance being greater than the first distance. It will be understood that, in other instances, the positions of fuze power inductor 141 and fuze signal inductor 140 relative to front wall 122*b* may be swapped and if this is the case then the positions of the fuze setter power inductor 160 and fuze setter signal inductor 161 illustrated in FIGS. 6A and 6B will be swapped as well.

Figure 7A:
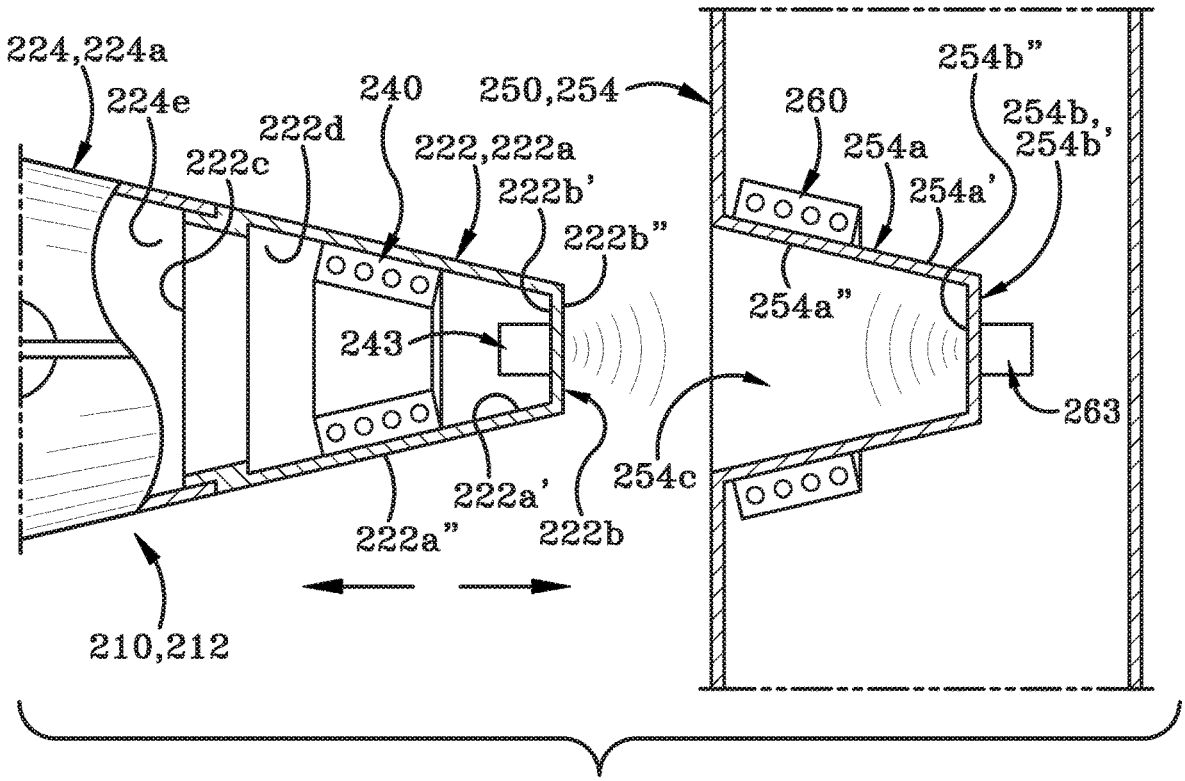
FIG. 7A is a cross-section showing a front end of the guided projectile located proximate the fuze setter and showing a third embodiment of a mechanism for providing high speed data and power to the guided projectile from the fuze setter.
Figure 7B:
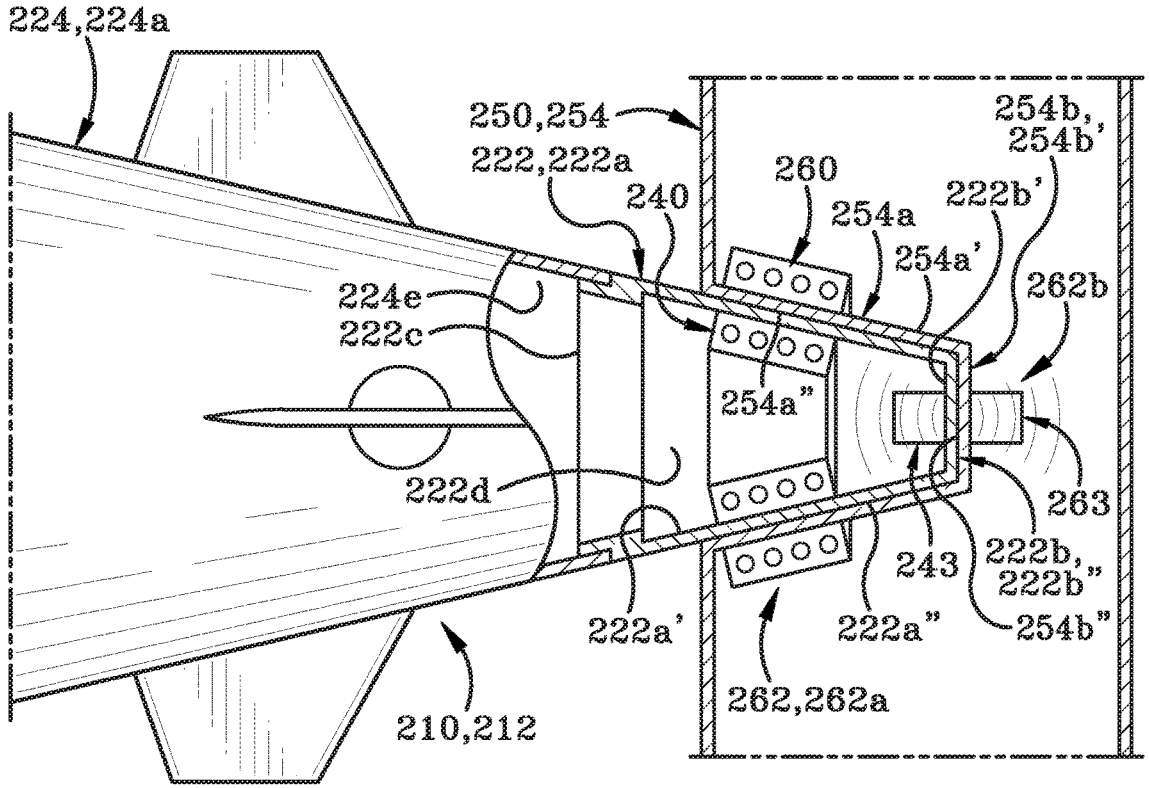
FIG. 7B is a partial cross-section of the front end of the guided projectile of FIG. 7A shown engaged in the fuze setter.
Figure 7C:
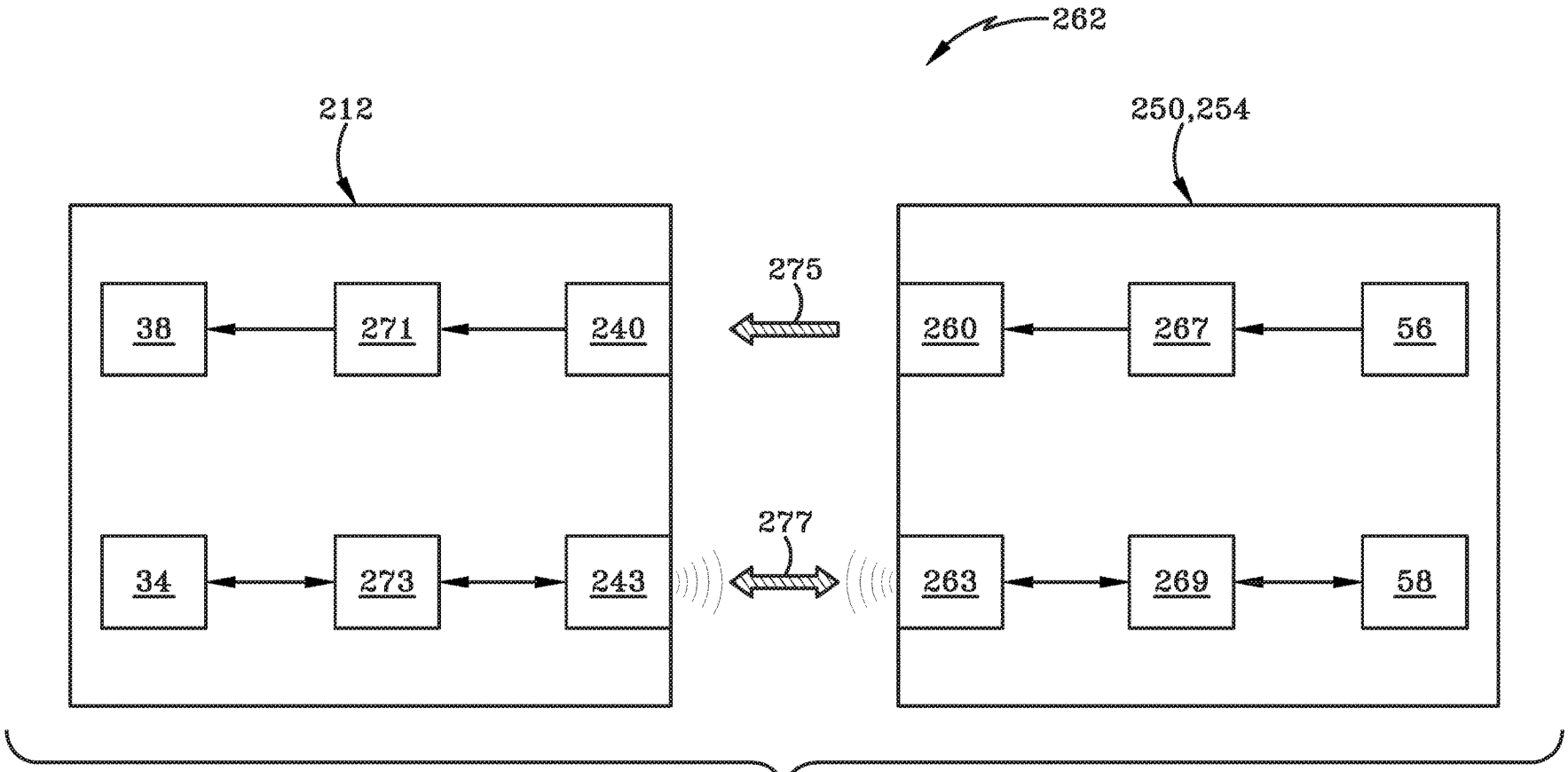
FIG. 7C is a flow chart showing a third method of providing high speed data and power to the guided projectile using the fuze setter.

FIGS. 7A to 7C show a third embodiment of the fuze setter interface in accordance with the present disclosure, generally indicated at 262 in FIG. 7B. A leading region of a guided projectile 210 is shown in FIG. 7A as including a fuze 212 having a radome housing 222 engaged with a fuze body 224. Fuze body 224 is substantially identical to fuze body 24 and includes a sidewall 224*a* that bounds and defines a cavity 224*e*. Substantially all of the same components that were in cavity 24*e* are located within the interior cavity 224*e*. Radome housing 222 is substantially identical to radome housing 22 in all aspects except radome housing 222 includes a fuze induction coil 240 and a radio frequency (RF) communications transceiver 243 instead of a single fuze induction coil 40. Fuze induction coil 240 is configured to be capable of electrical power transfer and RF transceiver 243 is configured to be capable of high speed communication.

Fuze induction coil 240 is configured as an annular inductive coil positioned within interior cavity 222*d* of radome housing 222. Fuze induction coil 240 is located inwardly from and adjacent to the interior circumferential surface 222*a*' of sidewall 222*a* of radome housing 222. No part of fuze induction coil 240 extends through sidewall 222*a* to the exterior surface 222*a*" thereof. In other words, the exterior surface 222*a*" of sidewall 222*a* is substantially continuous and uninterrupted between front wall 222*b* and rear end 222*c*. RF transceiver 243 is shown as being positioned inwardly from and adjacent to the interior surface 222*b*' of front wall 222*b*. No part of the RF transceiver 243 extends through front wall 222*b* to the exterior surface 222*b*".

Fuze setter station 254 on fuze setter 250 may be substantially identical to fuze setter station 54 in all aspects except fuze setter station 254 includes a fuze setter induction coil 260 and a RF transceiver 263 instead of the single fuze setter induction coil 60 of fuze setter station 54. Fuze setter induction coil 260 is configured to be capable of electrical power transfer and RF transceiver 263 is configured to be capable of high speed data communication.

Fuze setter induction coil 260 may be an annular inductive coil that is positioned outwardly from and adjacent to the interior circumferential surface 254*a*' of sidewall 254*a* of fuze setter station 254. No part of fuze setter induction coil 260 may extend through sidewall 254*a* to the exterior surface 254*a*" thereof. The exterior surface 254*a*" of sidewall 254*a* is therefore free of any obstructions or breaks. Fuze setter induction coil 260 is located to be matingly aligned with fuze induction coil 240 when radome housing 222 is inserted into port 254*c*. RF transceiver 263 is shown as being positioned inwardly from and adjacent to an interior surface 254*b*' of front wall 254*b*. No part of RF transceiver 263 extends through front wall 254*b* to the exterior surface 254*b*" and into port 254*c*. RF transceiver 263 is located to be matingly aligned with RF transceiver 243 when radome housing 222 is inserted into port 254*c*.

It will be understood that the RF transceiver 243 may, instead, be located adjacent the interior surface 222*a*' of sidewall 222*a* instead of proximate front wall 222*b*. The RF transceiver 243 may be spaced longitudinally from fuze induction coil 240. In one example, the fuze induction coil 240 may be located adjacent the interior surface 222*b*' of front wall 222*b* and RF transceiver 243 may be located adjacent the interior surface 222*a*' of sidewall 222*a*. Wherever fuze induction coil 240 and RF transceiver 243 are positioned on radome housing 222, it will be understood that the fuze setter induction coil 260 and RF transceiver 263 will be located in complementary positions to matingly align with fuze induction coil 240 and RF transceiver 243, respectively, when radome housing 222 is inserted into port 254*c* of fuze setter 250.

The fuze setter interface 262 is comprised of two independent interfaces, namely, an inductive electrical power interface 262*a* and a wireless radio frequency (RF) interface 262*b* for high speed data communications. The electrical power interface 262*a* provides for inductive coupling for electrical power transfer from fuze setter 250 to fuze 212. It is a high power, low speed interface for efficient electrical power transfer. The inductive electrical power interface 262*a* comprises fuze induction coil 240 and fuze setter induction coil 260.

The wireless RF interface 262*b* for high speed communications is a high speed RF interface for bidirectional data communications between fuze setter 250 and fuze 212. The wireless RF interface 262*b* is comprised of the RF transceiver 243 and the RF transceiver 263. Both of the RF transceiver 243 and RF transceiver 263 are capable of emitting and receiving transmission signals. Various RF interface embodiments, i.e., the transceivers 243, 263 might include BLUETOOTH® communications, radio-frequency identification (RFID) communications, e.g. active ultra-high frequency (UHF) RFID, and custom RF transceivers. (BLUETOOTH® is a registered trademark of BLUETOOTH SIG, INC. of Kirkland, Wash., US). In one example, Frequency Shift Keying (FSK) modulation of an RF carrier waveform may be utilized as a means to communication data across the wireless RF interface.

The fuze setter operation is shown in FIG. 7C as including electrical power transfer and data communication between fuze setter 250 and fuze 212. The fuze setter station 254 of fuze setter 250 includes a DC power source 56, a CPU 58, a fuze setter induction coil 260, an RF transceiver 263, an AC waveform generation function 267, and a signal conditioning function 269. AC waveform generation function 267 and signal conditioning function 269 may be functions performed by the programming of CPU 58 or by other components designed specifically to perform these functions. Fuze 212 includes a microprocessor 34, a fuze power supply 38, a fuze induction coil 240, an RF transceiver 243, a power conditioning function 271, and a modulation/demodulation function 273. Power conditioning function 271 and modulation/demodulation function 273 may be functions performed by the programming of microprocessor 34 or by other components designed specifically to perform these functions.

In the electrical power transfer, a fuze setter DC power source 56 is applied to AC waveform generation function 267 of fuze setter 250 and the DC power is converted to an AC waveform suitable for driving the fuze setter induction coil 260. The AC waveform is then applied to the fuze setter induction coil 260. In response to the applied AC waveform, the fuze setter induction coil 260 generates a magnetic field that couples 275 to the fuze induction coil 240 on the fuze 12 side of the electrical power interface 262*a* (FIG. 7B). Electrical power is transferred from fuze setter 250 to fuze 212 via this magnetic field coupling 275.

In the electric power transfer of the fuze operation, the fuze induction coil 240 generates an AC power waveform output in response to the magnetic field coupled 275 to the fuze induction coil 240 by the fuze setter induction coil 260. The AC power waveform is then input to the power conditioning function 271. The power conditioning function 271 performs functions including rectification, filtering, and voltage regulation as necessary and converts the AC power waveform into useable fuze power. The fuze power, which is DC power, may be transferred to fuze power supply 38.

The data communication may operate in either a half-duplex or full-duplex mode. The description that follows applies to either of the half-duplex or full-duplex modes of operation. In fuze setter transmit (fuze receive) mode, fuze setter data from CPU 58 is input to signal conditioning function 269. Within the signal conditioning function 269, the data is processed into a form that is compatible with transmission via the RF transceiver 263. This processing may include filtering, amplification, level control, and modulation of an RF carrier frequency. The output from the signal conditioning function 269 is applied to the input of RF transceiver 263 which wirelessly transmits the data via an antenna provided on the RF transceiver 263 across the interface 262*b* (FIG. 7B). This wireless transmission is identified by the reference number 277 in FIG. 7C. In fuze setter receive (fuze transmit) mode, the RF signal transmitted 277 by RF transceiver 243 and received by the antenna of the RF communication transceiver 263 is applied to the signal conditioning function 269 where the data is extracted from the RF waveform. The extracted data may be stored or utilized by the CPU 58.

In the data communications of the fuze operation, communication operates in a half-duplex mode. In fuze receive (fuze setter transmit) mode, data broadcast 277 by the fuze setter RF transceiver 263 is received via the fuze RF transceiver 243. Data is extracted in the modulation/demodulation function 273 for use by fuze 212. The data may be stored in the computer readable storage medium 32 of microprocessor 34 or may be utilized by microprocessor 34 to direct guided projectile 210 towards remote target 16 (FIG. 3).

In fuze transmit (fuze setter receive) mode, data from the fuze 212 is used to modulate a carrier frequency in the modulation/demodulation function 273. This modulated waveform is then input to the fuze RF communication transceiver 243 where it is broadcast 277 to the corresponding fuze setter RF transceiver 263.

In another embodiment, full duplex communication can be realized if the carrier frequency used by the transmitter portion of the fuze RF transceiver 243 is different than the carrier frequency used by the transmitter portion of the fuze setter RF transceiver 263. In this case, transmission of data modulated onto one carrier frequency can occur simultaneously with reception of data modulated onto a different carrier frequency.

Figure 8A:
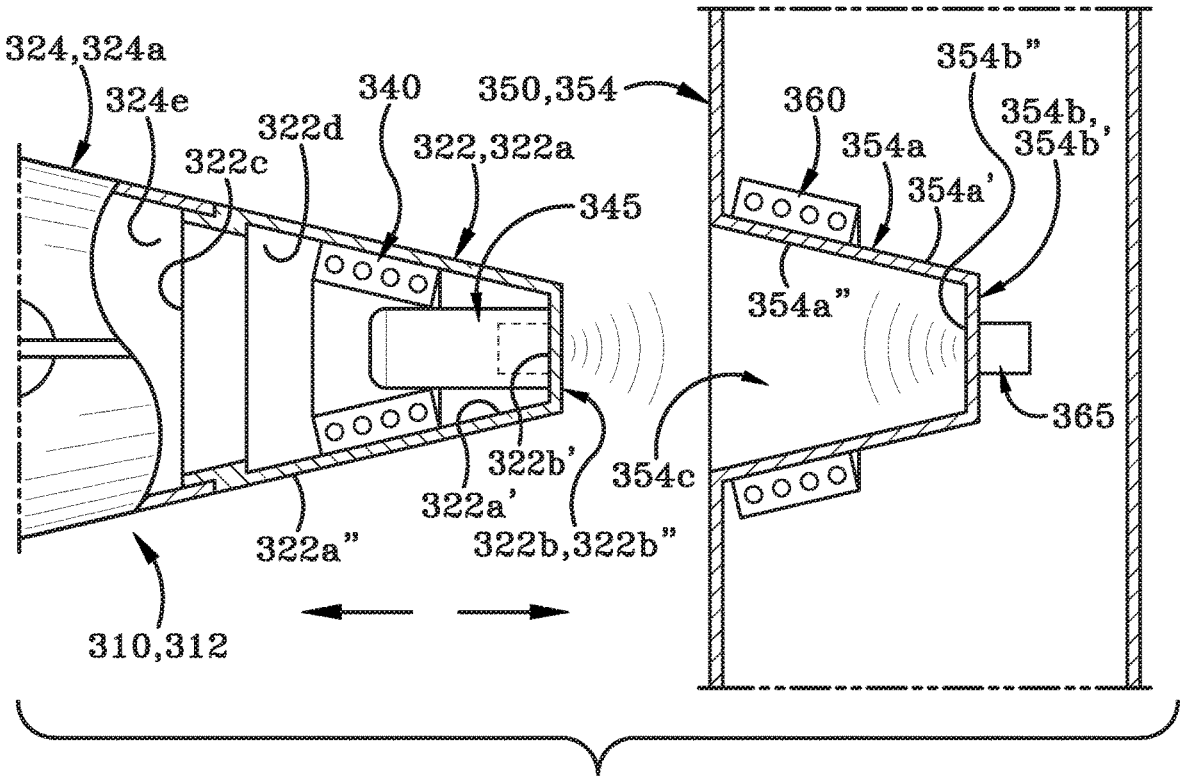
FIG. 8A is a cross-section showing a front end of the guided projectile located proximate the fuze setter and showing a fourth embodiment of a mechanism for providing high speed data and power to the guided projectile from the fuze setter.
Figure 8B:
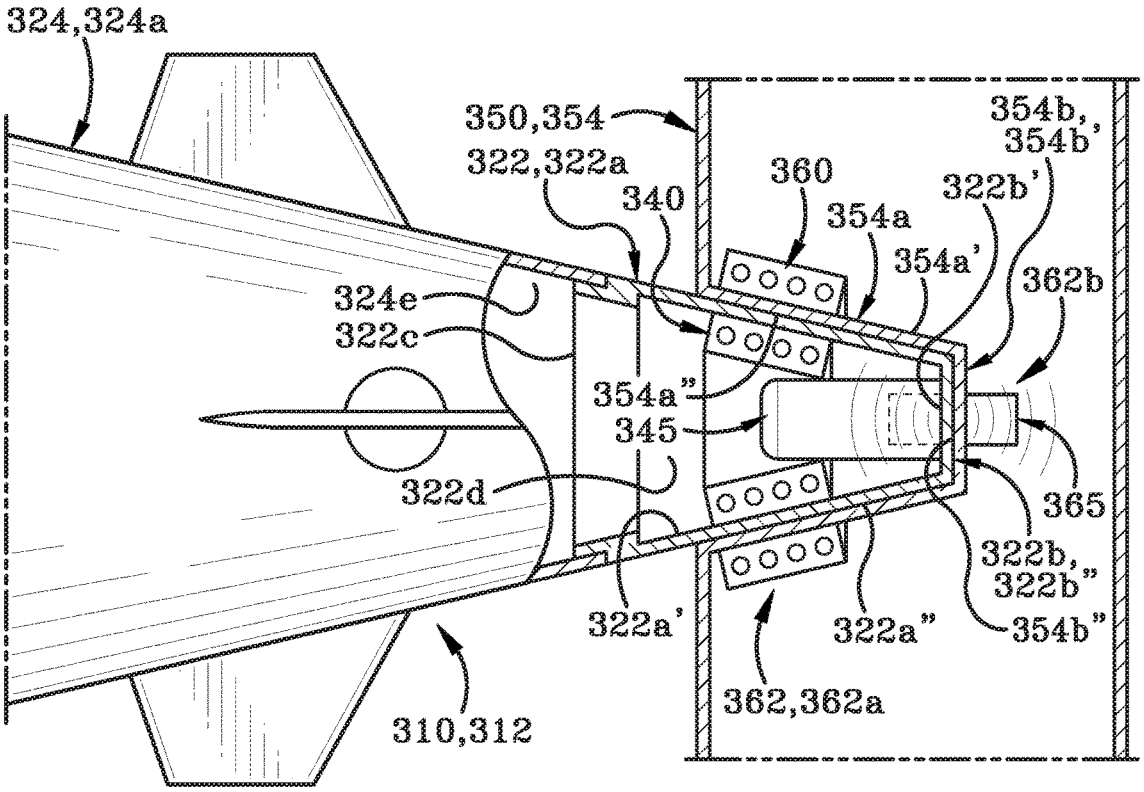
FIG. 8B is a partial cross-section of the front end of the guided projectile of FIG. 8A shown engaged in the fuze setter.

FIGS. 8A to 8D show a fourth embodiment of a fuze setter interface in accordance with the present disclosure, generally indicated at 362 in FIG. 8B. The fourth embodiment fuze setter interface 362 includes an inductive electrical power interface 362*a* (FIG. 8B) and a radio frequency interface 362*b* that permits data communications. In the electrical power interface 362A, electrical power may be transferred from fuze setter 350, 354 to fuze 312 via inductive coupling.

A leading region of a guided projectile 310 is shown in FIG. 8A as including a fuze 312 having a radome housing 322 engaged with a fuze body 324. Fuze body 324 is substantially identical to fuze body 24 and includes a sidewall 324*a* that bounds and defines an interior cavity 324*e*. The same components are located within the interior cavity 324*e* that were located in cavity 24*e*. Radome housing 322 is substantially identical to radome housing 22 in all aspects except radome housing 322 includes a fuze induction coil 340 and a Height of Burst (HoB) sensor 345 instead of a single fuze induction coil 40. Fuze induction coil 340 is configured to be capable of electrical power transfer and HoB sensor 345 is configured to be capable of high speed communications.

A HoB sensor contains a low power radar transceiver used for detecting distance above the ground. It operates by transmitting an RF output signal, receiving a reflected RF signal from a surface (typically the ground), and processing the received waveform in such a way as to determine the distance from the HoB sensor to the surface. Thus, a HoB Sensor has an inherent RF transmit and receive capability. The fourth embodiment uses this capability for a different purpose, namely, to allow RF communications with a compatible RF transceiver located within fuze setter 350. This avoids the complexity of adding a separate communications interface, since the communications capability is inherent in the HoB Sensor, although HoB sensors are not used for bidirectional communications purposes in the current state of the art. HoB sensors have been used in the prior art during projectile flight testing to transmit telemetry data to ground stations while in flight. Thus, they have been used for one-way data communications. However, HoB sensors have not been used for bidirectional communication, where the HoB antenna is used to receive data transmitted to it from an external source. Additionally, HoB sensors have not been used to support fuze setting applications.

Fuze induction coil 340 is configured as an annular inductive coil positioned within interior cavity 322*d* of radome housing 322. Fuze induction coil 340 is located inwardly from and adjacent to the interior circumferential surface 322*a*' of sidewall 322*a* of radome housing 322. No part of fuze induction coil 340 extends through sidewall 322*a* to the exterior surface 322*a*" thereof. In other words, the exterior surface 322*a*" of sidewall 322*a* is substantially continuous and uninterrupted between front wall 322*b* and rear end 322*c*.

HoB sensor 345 is shown as being positioned inwardly from and adjacent to the interior surface 322*b*' of front wall 322*b*. No part of the HoB sensor 345 extends through front wall 322*b* to the exterior surface 322*b*".

Fuze setter station 354 on fuze setter 350 may be substantially identical to fuze setter station 54 in all aspects except fuze setter station 354 includes a fuze setter induction coil 360 and a RF transceiver 365 instead of the single fuze setter induction coil 60 of fuze setter station 54. Fuze setter induction coil 360 is configured to be capable of electrical power transfer and RF transceiver 365 is configured to be capable of high speed data communication.

Fuze setter induction coil 360 may be an annular inductive coil that is positioned outwardly from and adjacent to the interior circumferential surface 354*a*' of sidewall 354*a* of fuze setter station 354. No part of fuze setter induction coil 360 may extend through sidewall 354*a* to the exterior surface 354*a*" thereof. The exterior surface 354*a*" of sidewall 354*a* is therefore free of any obstructions or breaks. Fuze setter induction coil 360 is located to be matingly aligned with fuze induction coil 340 when radome housing 322 is inserted into port 354*c*. RF transceiver 365 is shown as being positioned inwardly from and adjacent to an interior surface 354*b*' of front wall 354*b*. No part of RF transceiver 365 extends through front wall 354*b* to the exterior surface 354*b*" and into port 354*c*. RF transceiver 365 is located to be matingly aligned with HoB sensor 345 when radome housing 322 is inserted into port 354*c*.

It will be understood that the HoB sensor 345 may, instead, be located adjacent the interior surface 322*a*' of sidewall 322*a* instead of proximate front wall 322*b*. The HoB sensor 345 may be spaced longitudinally from fuze induction coil 340. In one example, the fuze induction coil 340 may be located adjacent the interior surface 322*b*' of front wall 322*b* and HoB sensor 345 may be located adjacent the interior surface 322*a*' of sidewall 322*a*. Wherever fuze induction coil 340 and HoB sensor 345 are positioned on radome housing 322, it will be understood that the fuze setter induction coil 360 and RF transceiver 365 will be located in complementary positions to matingly align with fuze induction coil 340 and HoB sensor 345, respectively, when radome housing 322 is inserted into port 354*c* of fuze setter 350.

As indicated above, the communications interface 362*b* includes HoB sensor 345. HoB sensor 345 is an RF transceiver capable of broadcasting RF and detecting reflected RF returns and utilizing the same to determine the projectile's height above the ground. Since HoB sensors have both RF transmit and receive capability, the present disclosure conceives utilizing that capability to form a data communication interface 362*b* with an RF transceiver 365 that the inventor has located in a mating position within the fuze setter 350. The RF transceiver 365 is located in the immediate vicinity of the HoB sensor 345. The close proximity of the HoB sensor 345 and RF transceiver 365 enables rapid transfer of data between fuze setter 350 and fuze 312. The present disclosure includes setting up the system such that appropriate modulation of an RF carrier waveform in this system enables the HoB sensor 345 to function as a bidirectional RF transceiver for data transmission. In one example, FSK modulation of the RF waveform may be utilized. The advantage of utilizing a HoB sensor 345 as an RF transceiver is that this approach utilizes the existing RF transceiver capability of the HoB sensor without requiring the provision of a separate RF transceiver in the projectile for use as part of the data communication interface.

In one example, data is communicated between fuze 312 and fuze setter 350, 354 via RF communications interface 362*b* utilizing HoB sensor 345 and the HoB sensor 345 nominally contains an RF transceiver for height detection using RF Doppler techniques. The RF transceiver in the HoB sensor 345 can be adapted for bidirectional communication.

Figure 8C:
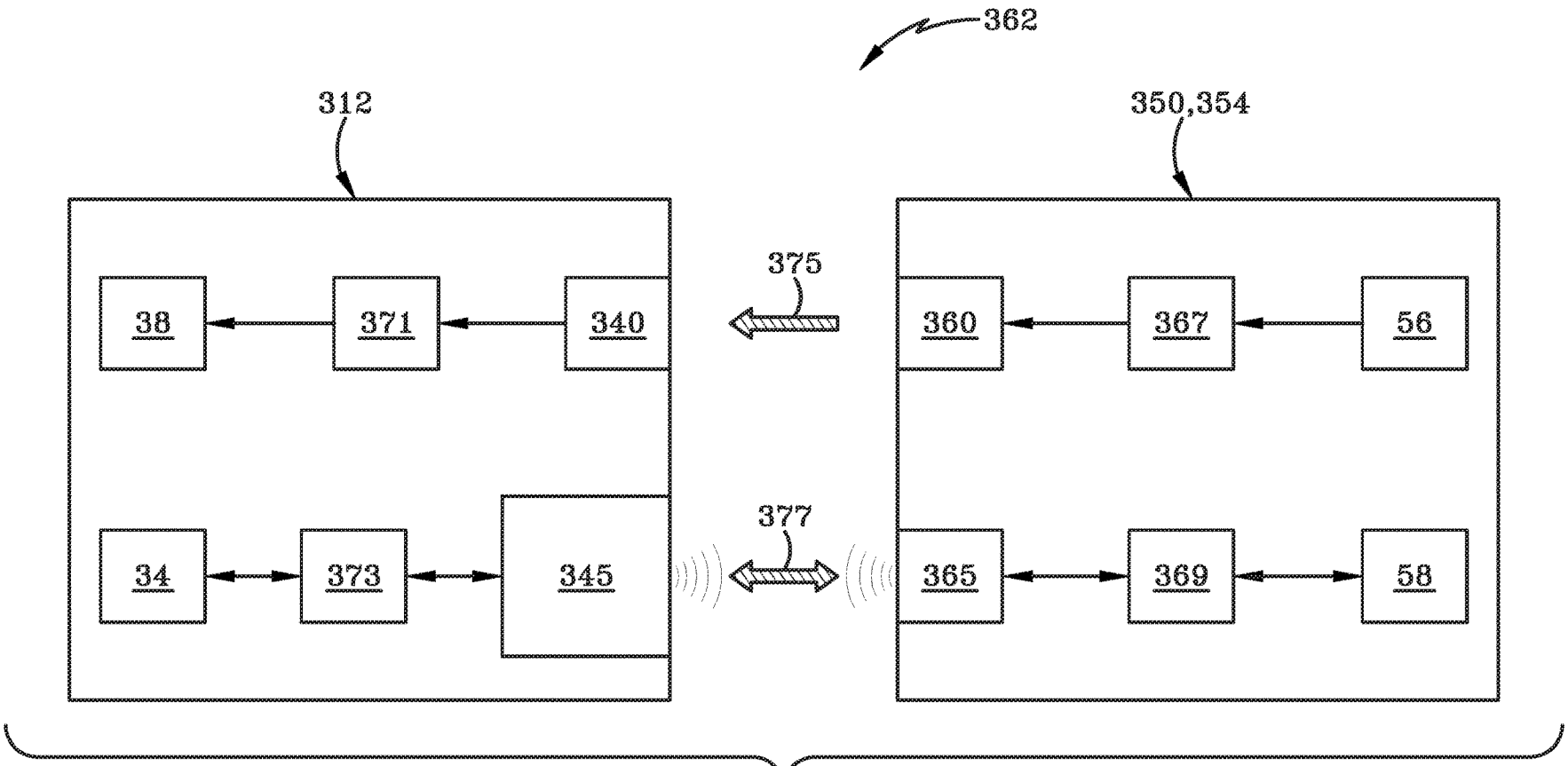
FIG. 8C is a flow chart showing a fourth method of providing high speed data and power to the guided projectile using the fuze setter.

Referring to FIG. 8C, fuze setter 350, 354 includes a DC power source 56, a CPU 58, a fuze setter induction coil 360, an RF transceiver 365, an AC waveform generation function 367, and a signal conditioning function 369. AC waveform generation function 367 and a signal conditioning function 369 may be functions performed by programming of CPU 58 or may performed by other components. Fuze 312 includes a microprocessor 34, a fuze power supply 38, a fuze induction coil 340, HoB sensor 345, a power conditioning function 371 and a data processing function 373. Power conditioning function 371 and data processing function 373 may be functions performed by the programming of microprocessor 34 or by other components provided to perform these functions.

Because HoB sensor 345 acts as an RF transceiver, fuze setter interface 362 disclosed in FIGS. 8A-8D functions in a substantially similar manner to the fuze setter interface 262. Referring to FIG. 8C, in the electrical power transfer, a fuze setter DC power source 56 is applied to an AC waveform generation function 67 where the DC power is converted to an AC waveform suitable for driving the fuze setter induction coil 360. The AC waveform is applied to the fuze setter induction coil 360 and in response to the applied AC waveform, the fuze setter induction coil 260 generates a magnetic field that couples 375 to the fuze induction coil 240 on the fuze 312 side of the electrical power interface 362*a* (FIG. 8B). Electrical power is transferred from fuze setter 350 to fuze 312 via this magnetic field coupling 375.

In the electric power transfer of the fuze operation, the fuze induction coil 340 generates an AC power waveform output in response to the magnetic field coupled 375 to the fuze induction coil 340 by the fuze setter induction coil 360. The AC power waveform is then input to the power conditioning function 371 of fuze 312. The power conditioning function 371 performs functions including rectification, filtering, and voltage regulation as necessary and converts the AC power waveform into useable fuze power. The fuze power, which is DC power, may be transferred to fuze power supply 38.

The data communication may operate in either a half-duplex or full-duplex mode. The description that follows applies to either of the half-duplex or full-duplex modes of operation. In fuze setter transmit (fuze receive) mode, fuze setter data from CPU 58 is input to a signal conditioning function 369. Within the signal conditioning function 369, the data is processed into a form that is compatible with transmission via the RF transceiver 365. This processing may include filtering, amplification, level control, and modulation of an RF carrier frequency. The output from the signal conditioning function 369 is applied to the input of RF communication transceiver 365 which wirelessly transmits 377 the data via an antenna on transceiver 365 across the interface 362*b* (FIG. 8B). In fuze setter receive (fuze transmit) mode, the RF signal received 377 by the antenna of RF transceiver 365 is applied to the signal conditioning function where the data is extracted from the RF waveform. The extracted data may be stored or utilized by the CPU 58.

In the data communications of the fuze operation shown in FIG. 8C, communication operates in a half-duplex mode. In fuze receive (fuze setter transmit) mode, data broadcast 377 by the fuze setter RF transceiver 365 is received via the antenna of HoB sensor 345. Data from microprocessor 34 is applied to data processing function 373 which conditions the information for RF transmission via the Height of Burst Sensor 345. Data output from the Data processing function 373 is applied to the HoB Sensor 345 to generate RF output 377. Data is extracted in data processing function 373 and that data may be stored in the computer readable storage medium 32 of fuze 312 or may be utilized to perform functions within guided projectile 310, or to direct guided projectile 310 towards the remote target.

In another embodiment, full duplex communication can be realized if the carrier frequency used by the transmitter portion of the HoB sensor 345 is different than the carrier frequency used by the transmitter portion of the fuze setter RF transceiver 365. In this case, transmission of data modulated onto one carrier frequency can occur simultaneously with reception of data modulated onto a different carrier frequency.

Figure 8D:
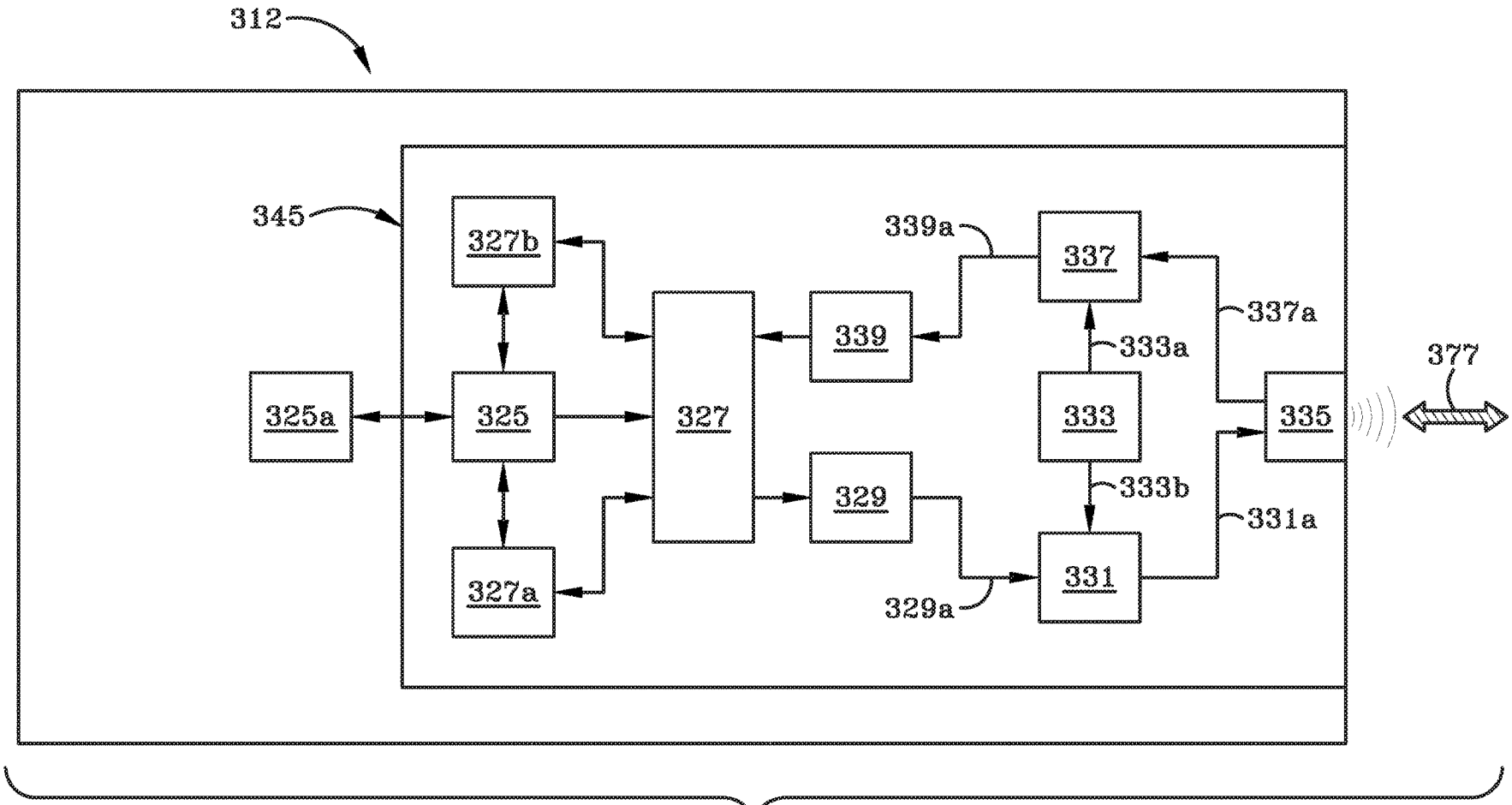
FIG. 8D is a flow chart showing additional detail regarding the implementation of the fourth embodiment, particularly with regard to how to switch between fuze setting communications mode and height detection mode.

FIG. 8D flow chart showing additional detail regarding the implementation of the fourth embodiment, particularly with regard to how to switch between fuze setting communications mode and height detection mode. FIG. 8D also shows how, when in communications mode to both encode an RF waveform with data in the fuze 312 to send data back to fuze setter 350 when in fuze transmit (fuze setter receive mode), and how to decode data encoded on an RF waveform received from the fuze setter when in fuze setter transmit (fuze receive mode). In the communications operation, a microcontroller 325 within HoB sensor 345 selects a communications mode 327*a* via a HoB/Communications mode select switch 327 (HoB/Comms Mode select switch) instead of a height detection mode 327*b*. Once communications mode has been selected, communications between the fuze setter 350 and the fuze 312 is enabled. Operation of the fuze transmit (fuze setter receive) mode is first described. Data from fuze 312 is applied to a communications function via microcontroller 325, where preprocessing 325*a* may be performed. Data to be transmitted flows from the communications function via the microcontroller 325, through the HoB/Comms mode select switch 327 and to the digital-to-analog converter (DAC) 329, where it is converted to an appropriate analog waveform. The data-encoded analog waveform 329*a* is applied to an RF modulator 331. Also applied to the RF modulator is the RF transmit carrier frequency 333*b* generated by RF carrier frequency generator 333. The RF modulator 331 modulates the RF transmit carrier frequency 333*b* with the transmitted data-encoded analog waveform 329*a*, to generate the modulated RF transmit carrier frequency 331*a*, which is then applied to the antenna 335. The fuze setter 350 receives this modulated RF transmit carrier waveform 331*a* and applies it to a demodulation function to extract the data encoded in the waveform. Operation of the fuze receive (fuze setter transmit) mode is now described. In this mode, a modulated RF receive carrier frequency 337*a*, encoded with data from the fuze setter is detected by fuze antenna 335 and applied to the RF Demodulator 337. Also applied to the RF demodulator is the receive carrier frequency 333*a*. The RF demodulator uses this receive carrier frequency 333*a* to extract the data encoded in the modulated RF receive carrier frequency 337*a*. The RF demodulator outputs this data as a received data-encoded analog waveform 339*a*, which is then applied as an input to an analog-to-digital converter (ADC) 339, to convert the waveform data to digital form. This data is then transferred through the HoB/Comms Mode Select switch 327, allowing it to be input to the Communications function 327 and microcontroller 325. The RF carrier frequency generator 333 can generate a transmit carrier frequency 333*b* and receive carrier frequency 333*a*, which can be the same frequency, or they can be different frequencies. Use of different frequencies allows for simultaneous transmission of data on one carrier frequency while receiving data modulated onto a second carrier frequency. It will be understood that the RF modulation/demodulation described above is one of many possible ways of encoding data onto a carrier.

Received data from fuze setter 350 is detected by the RF antenna of HoB sensor 345 in the form of an RF modulated carrier signal. The modulated RF carrier signal is applied to the RF demodulator 337 which extracts that data waveform from the RF carrier. The data waveform is then applied to the analog-to-digital converter (ADC) 339 where it is converted back to digital form. Digital data is then transferred to the communications function via the mode select switch 327 for any additional processing. The digital data may be processed by data processing function 373 as described earlier herein.

Figure 9A:
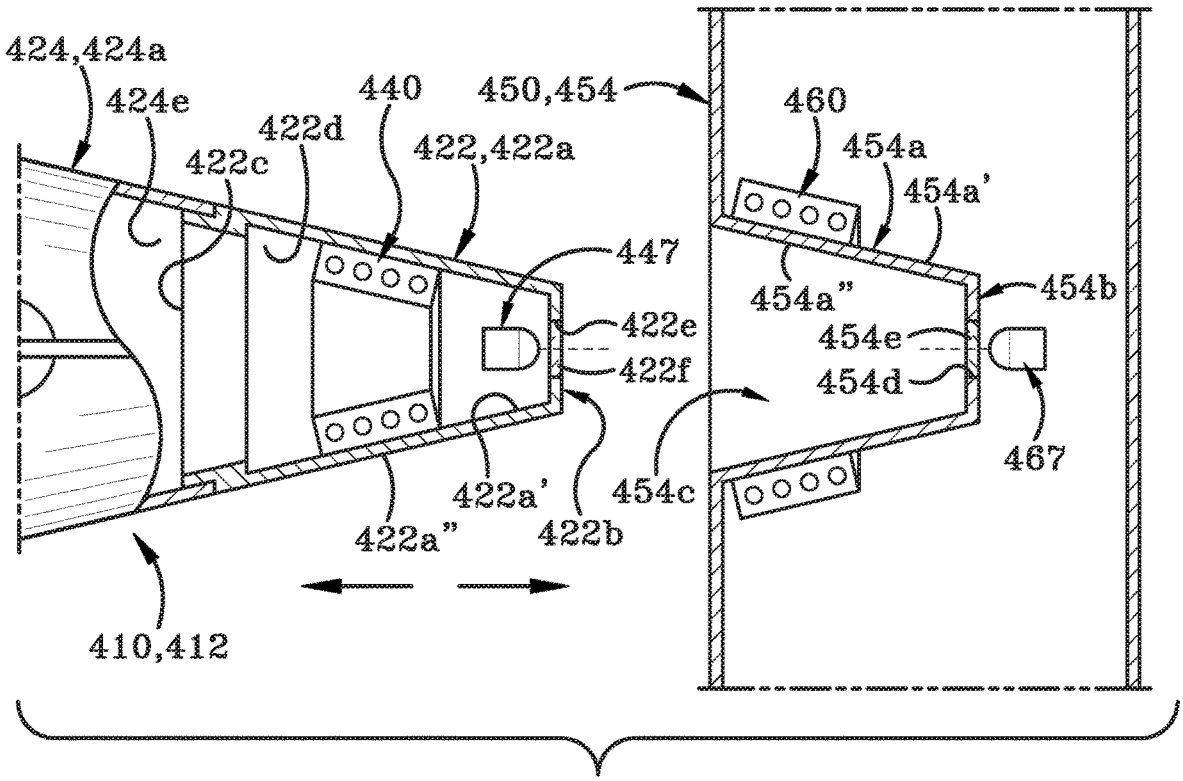
FIG. 9A is a cross-section showing a front end of the guided projectile located proximate the fuze setter and showing a fifth embodiment of a mechanism for providing high speed data and power to the guided projectile from the fuze setter.
Figure 9B:
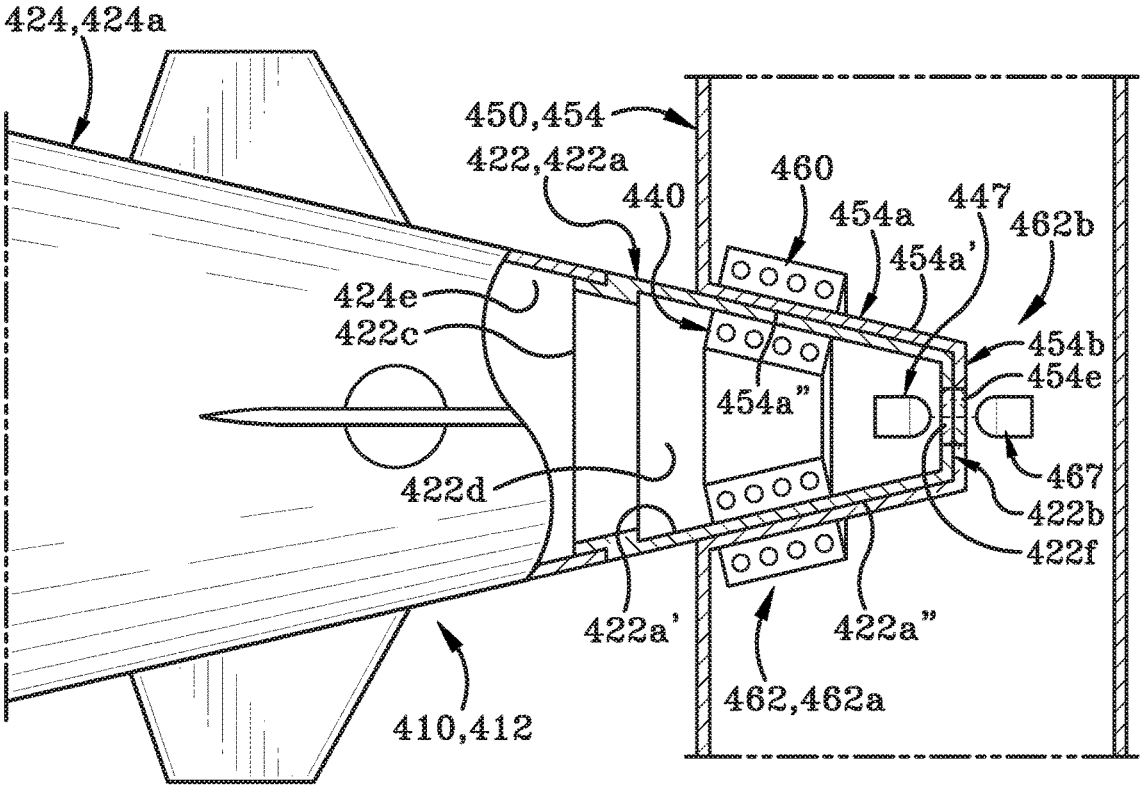
FIG. 9B is a partial cross-section of the front end of the guided projectile of FIG. 9A shown engaged in the fuze setter.
Figure 10A:
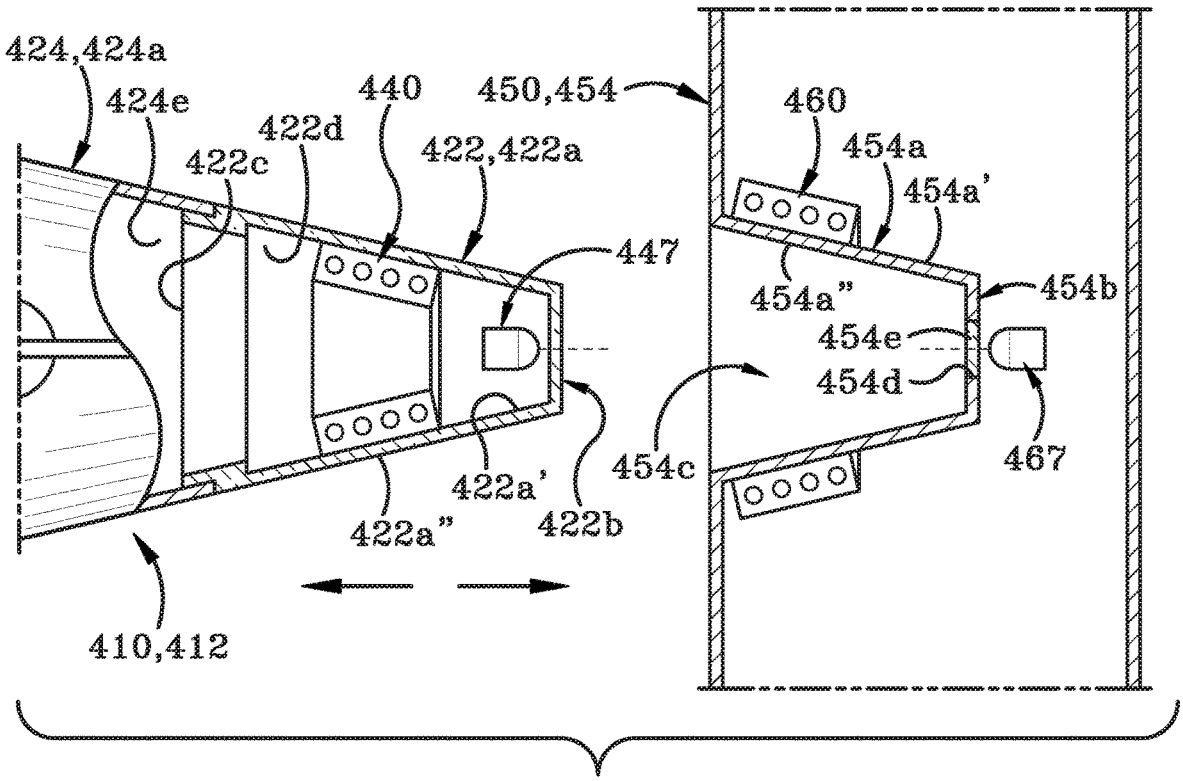
FIG. 10A is a cross-section showing an alternative embodiment of the front end of the guided projectile located proximate the fuze setter and showing the sixth embodiment of the mechanism for providing high speed data and power to the guided projectile from the fuze setter.
Figure 10B:
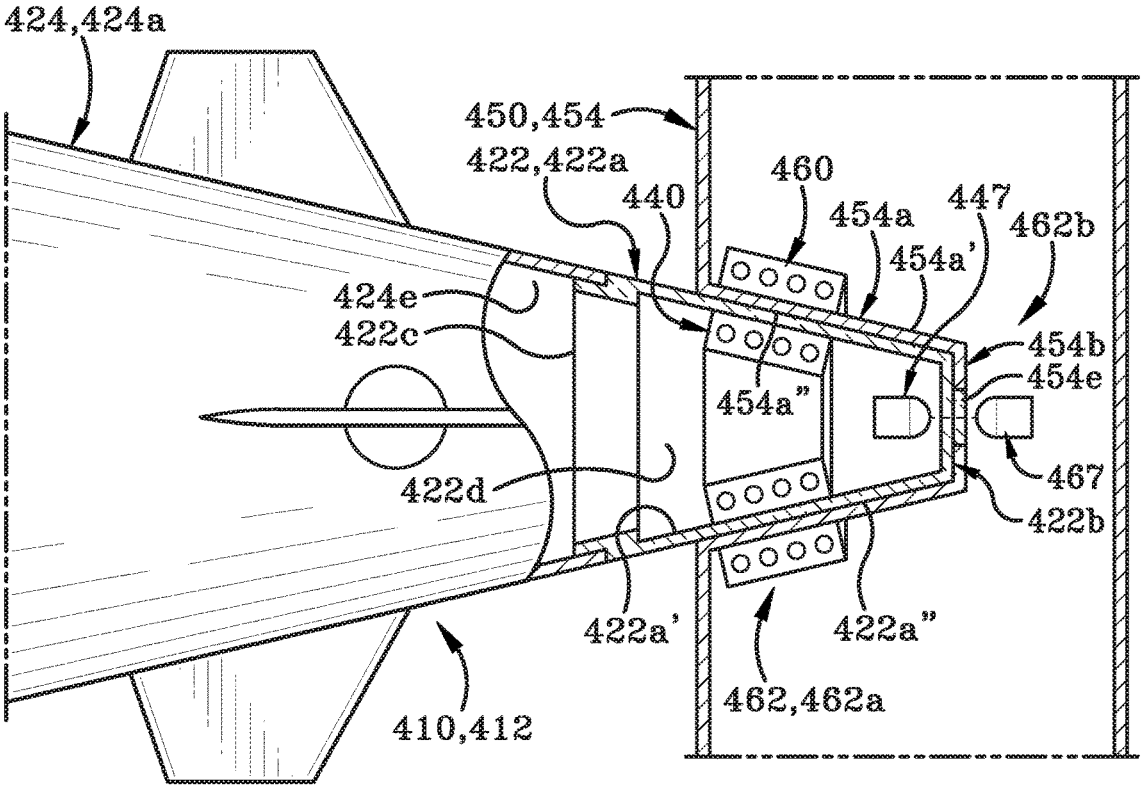
FIG. 10B is a partial cross-section of the front end of the guided projectile of FIG. 10A shown engaged in the fuze setter.

FIGS. 9A-9B show a fifth embodiment of a fuze setter interface in accordance with the present disclosure, generally indicated at 462 in FIG. 9B. FIGS. 10A-10B show another example of the fifth embodiment of the fuze setter interface 462. A leading region of a guided projectile 410 is shown in FIG. 9A as including a fuze 412 having a radome housing 422 engaged with a fuze body 424. Fuze body 424 is substantially identical to fuze body 24 and includes a sidewall 424*a* that bounds and defines an interior cavity 424*e*. The same components are located within the interior cavity 424*e* that are located in cavity 24*e*. Radome housing 422 is substantially identical to radome housing 22 in all aspects except radome housing 422 includes a fuze induction coil 440 and an optical transceiver 447 (also referred to as an optocoupler) instead of a single fuze induction coil 40. Fuze induction coil 440 is configured to be capable of electrical power transfer and optical transceiver 447 is configured to be capable of high speed communication.

Fuze induction coil 440 is configured as an annular inductive coil positioned within interior cavity 422*d* of radome housing 422. Fuze induction coil 440 is located inwardly from and adjacent to the interior circumferential surface 422*a*' of sidewall 422*a* of radome housing 422. No part of fuze induction coil 440 extends through sidewall 422*a* to the exterior surface 422*a*" thereof. In other words, the exterior surface 422*a*" of sidewall 422*a* is substantially continuous and uninterrupted between front wall 422*b* and rear end 422*c*.

Optical transceiver 447 is shown as being positioned inwardly from and adjacent to the interior surface 422*b*' of front wall 422*b*. No part of the optical transceiver 447 extends through front wall 422*b* to the exterior surface 422*b*". FIG. 9A shows that front wall 422*b* of radome housing 422 defines an aperture 422*e* therein that extends between an interior and exterior surface of wall 422*b*. An optically-transparent window 422*f* is mounted within aperture 422*e*. Optical transceiver 447 is aligned with window 422*f* so that optical signals may be transmitted and received through window 422*f*.

Fuze setter station 454 on fuze setter 450 may be substantially identical to fuze setter station 54 in all aspects except fuze setter station 454 includes a fuze setter induction coil 560 and an optical transceiver 467 instead of the single fuze setter induction coil 60 of fuze setter station 54. Fuze setter induction coil 460 is configured to be capable of electrical power transfer and optical transceiver 467 is configured to be capable of high speed data communications.

Fuze setter induction coil 460 may be an annular inductive coil that is positioned outwardly from and adjacent to the interior circumferential surface 454*a*' of sidewall 44*a* of fuze setter station 454. No part of fuze setter induction coil 460 may extend through sidewall 454*a* to the exterior surface 454*a*" thereof. The exterior surface 454*a*" of sidewall 454*a* is therefore free of any obstructions or breaks. Fuze setter induction coil 460 is located to be matingly aligned with fuze induction coil 440 when radome housing 422 is inserted into port 454*c*.

Optical transceiver 467 is shown as being positioned inwardly from and adjacent to an interior surface 454*b*' of front wall 454*b*. No part of optical transceiver 467 extends through front wall 454*b* to the exterior surface 454*b*" and into port 454*c*. Optical transceiver 467 is located to be matingly aligned with window 422*f* and optical transceiver 447 when radome housing 422 is inserted into port 454*c*. In one example, front wall 454*b* defines an aperture 454*d* therein that extends between an interior and exterior surface of wall 454*b*. An optically-transparent window 454*e* is mounted within aperture 454*d*. Optical transceiver 467 is aligned with window 454*e* and is configured to transmit and receive optical signals through window 454*e*.

The fifth embodiment fuze setter interface 462 (FIG. 9B) is comprised of two independent interfaces, namely an inductive electrical power interface 462*a* and an optical link for wireless, high speed, data communications 462*b*. The electrical power interface 462*a* includes inductive coupling for electrical power transfer from fuze setter 450 to fuze 412. This is a high speed, low power interface for efficient electrical power transfer.

The optical data link for high speed data communications includes the two optical transceivers 447, 467 (optocoupler) for high-speed bidirectional data communications between fuze setter 450 and fuze 412. Optical transceivers 447, 467 may be very small and may be made highly secure by shielding the optical energy from external sensors. Optical energy may be transmitted through the optical windows 422*f* and 454*e*, as shown in FIG. 9B.

FIGS. 10A-10B show a sixth embodiment of fuze setter interface 462 that is substantially identical to the example shown in FIGS. 9A-9B except that the front wall 422*b* of radome housing 422 does not include aperture 422*e* or window 422*f*. Instead, front wall 422*b* is fabricated from an optically transparent material. Front wall 454*b* of fuze setter 450 is illustrated as still including aperture 454*d* and window 454*e* but it will be understood that front wall 454*b* may, instead, be entirely fabricated from an optically transparent material. In another example (not shown), the front wall 454*b* of fuze setter 450 may be entirely fabricated from the optically transparent material and the radome housing 422 may be configured as shown in FIG. 9A or FIG. 10A. Fuze setter 450 may be fabricated in any manner that will permit optical energy to get into the fuze setter 450 and out of fuze setter 450 in some way. In another example (not shown), fuze setter 450 could use optical fibers instead of a window or a transparent wall.

In either instance, the material used for one or more of windows 422*f*, 454*e*, front wall 422*b* of radome housing 422 and front wall 454*b* of fuze setter 450 may be fabricated from a material, such a polymer that is transparent or substantially transparent at any desired, particular optical energy wavelength. Many polymers are transparent in various wavelength bands. Radome housing i.e., walls 454*a* and 454*b*, may be fabricated from this optically transparent or substantially optically transparent material. One or more of windows 422*f*, 454*e*, and walls 422*b*, 454*b* are therefore fabricated to permit transmission of optical signals therethrough. The material for the optical transmission windows 422*f*, 454*e*, and walls 422*b*, 454*b* is selected so as to be compatible with the operating wavelength of the associated optical transceiver 447, 467. Optical energy may be transmitted directly through the optical transmission windows 422*f*, 454*e* as in FIGS. 9A-9B. In another embodiment, at least the front wall 422*b* of radome housing 422 is fabricated from this optically transparent polymeric material. In the latter embodiment, optical energy may be transmitted directly through the front wall 422*b* of radome housing 422 without the need for a separate optical window. This latter embodiment, shown in FIGS. 10A-10B may be fabricated for a lower cost and has higher reliability relative to the embodiment shown in FIGS. 9A-9B because no optical transmission window is present.

Figure 10C:
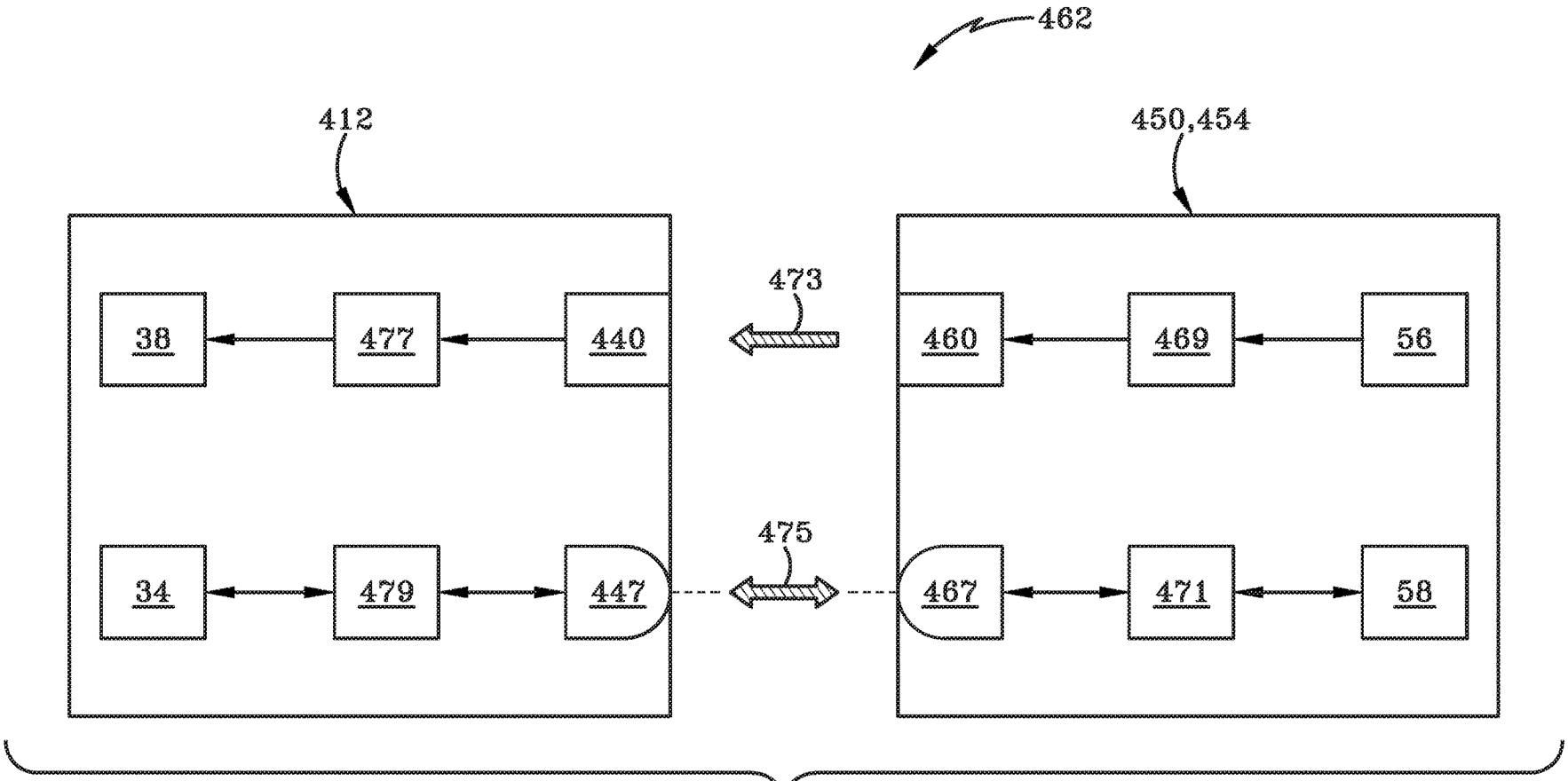
FIG. 10C is a flow chart showing a fifth method of providing high speed data and power to the guided projectile using the fuze setter utilizing the arrangement shown in FIGS. 9A through to 10B.

FIG. 10C shows the operation of fuze setter interface 462. The operation is the same regardless of whether the configuration of interface 462 is the example shown in FIGS. 9A-9B or the example shown in FIGS. 10A-10B. The fuze setter operation is shown in FIG. 10C as including electrical power transfer and data communication between fuze setter 450 and fuze 412. Fuze setter 450, 454 includes a DC power source 56, a CPU 58, a fuze setter induction coil 460, an optical transceiver 467, an AC waveform generation function 469, and a signal conditioning function 471. AC waveform generation function 469 and signal conditioning function 471 may be functions performed by the programming of CPU 58 or by other components designed specifically to perform these functions.

Fuze 412 includes a microprocessor 34, a fuze power supply 38, a fuze induction coil 440, an optical transceiver 447, a power conditioning function 477, and signal conditioning function 479. Power conditioning function 477 and signal conditioning function 479 may be functions performed by the programming of microprocessor 34 or by other components designed specifically to perform these functions.

In the electrical power transfer, a fuze setter DC power source 56 is applied to AC waveform generation function 469 of fuze setter 450 and the DC power is converted to an AC waveform suitable for driving the fuze setter induction coil 460. The AC waveform is then applied to the fuze setter induction coil 460. In response to the applied AC waveform, the fuze setter induction coil 460 generates a magnetic field that couples 473 to the fuze induction coil 440 on the fuze 12 side of the electrical power interface 462*a* (FIG. 9B, FIG. 10B). Electrical power is transferred from fuze setter 450 to fuze 412 via this magnetic field coupling 473.

The data communication may operate in either a half-duplex or full-duplex mode. In fuze setter transmit (fuze receive) mode, fuze setter data is input to signal conditioning function 471. Within the signal conditioning function 471, the data is processed into a form that is compatible with transmission via the optical transceiver 467. The output from the signal conditioning function 471 is applied to the input of optical transceiver 467 which transmits 475 the data optically to optical transceiver 447 on fuze 412. In fuze setter receive (fuze transmit) mode, an optical signal transmitted 475 from optical transceiver 447 and received by optical transceiver 467 is applied to the signal conditioning function 471 where the data is extracted from the waveform. The extracted data may be stored or utilized by the CPU 58.

In the electric power transfer of the fuze operation, the fuze induction coil 440 generates an AC power waveform output in response to the magnetic field coupled 473 to the fuze induction coil 440 by the fuze setter induction coil 460. The AC power waveform is then input to the power conditioning function 477. The power conditioning function 477 performs functions including rectification, filtering, and voltage regulation as necessary and converts the AC power waveform into useable fuze power. The fuze power, which is DC power, may be transferred to fuze power supply 38.

In fuze receive (fuze setter transmit) mode, an optical signal 475 transmitted by optical transceiver 467 is received by optical transceiver 447. Data is extracted in the signal conditioning function 479 for use by fuze 212. The data may be stored or utilized by microprocessor 34.

In fuze transmit (fuze setter receive) mode, data from the fuze 412 is processed in the signal conditioning function 479. Within the signal conditioning function 479, the data is processed into a form that is compatible with transmission via the optical transceiver 447. The output from the signal conditioning function 479 is applied to the input of optical transceiver 447 which transmits 475 the data optically to the corresponding optical transceiver 467 on fuze setter 450.

Figure 11A:
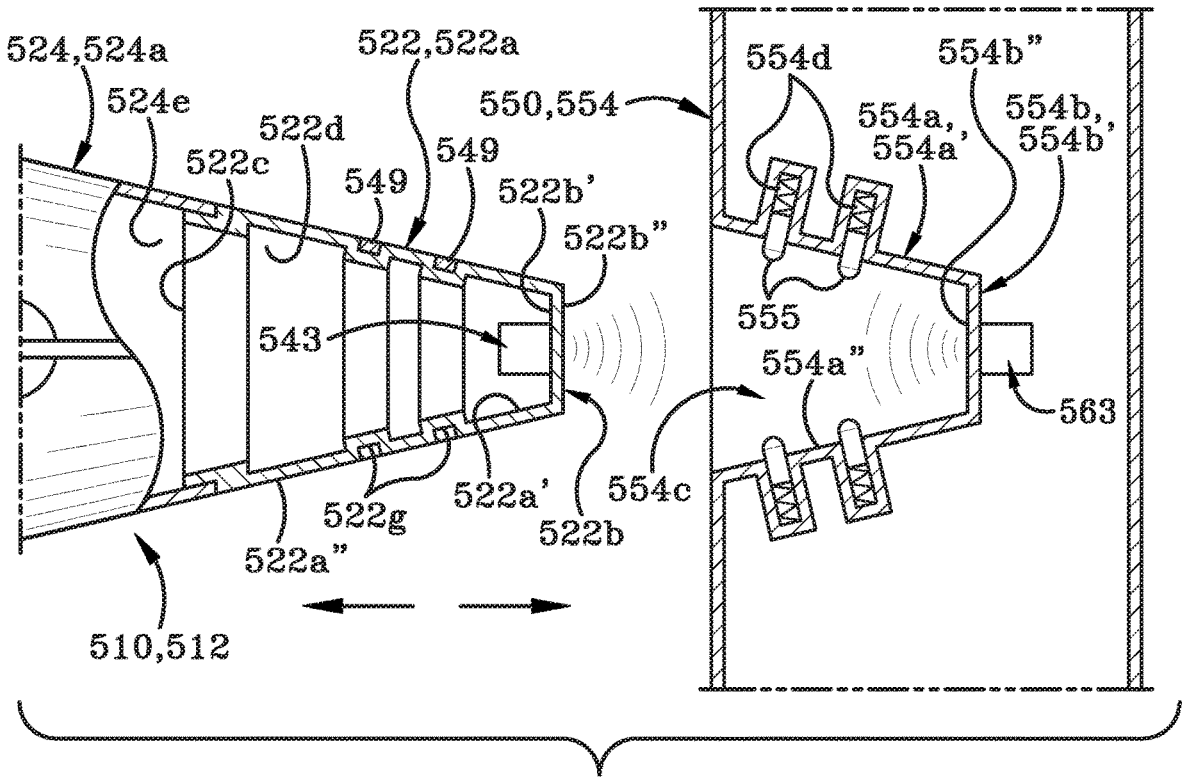
FIG. 11A is a cross-section showing a front end of the guided projectile located proximate the fuze setter and showing a seventh embodiment of a mechanism for providing high speed data and power to the guided projectile from the fuze setter.
Figure 11B:
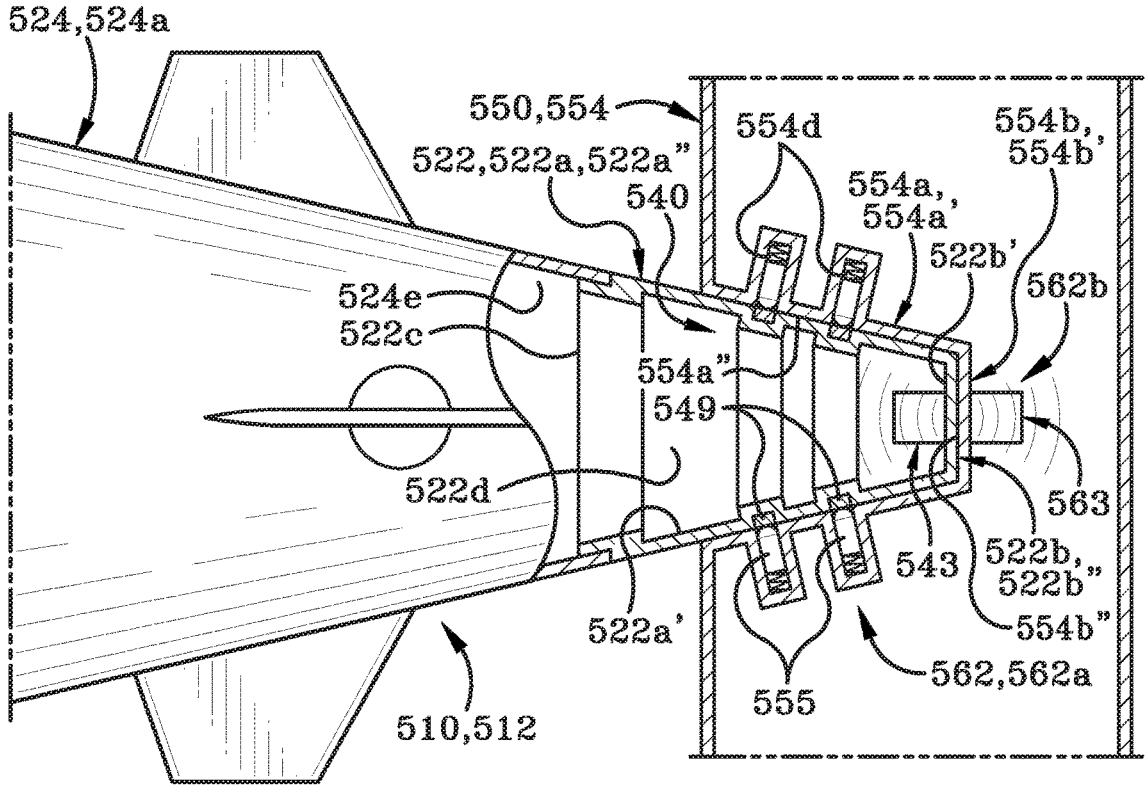
FIG. 11B is a partial cross-section of the front end of the guided projectile of FIG. 11A shown engaged in the fuze setter.
Figure 11C:
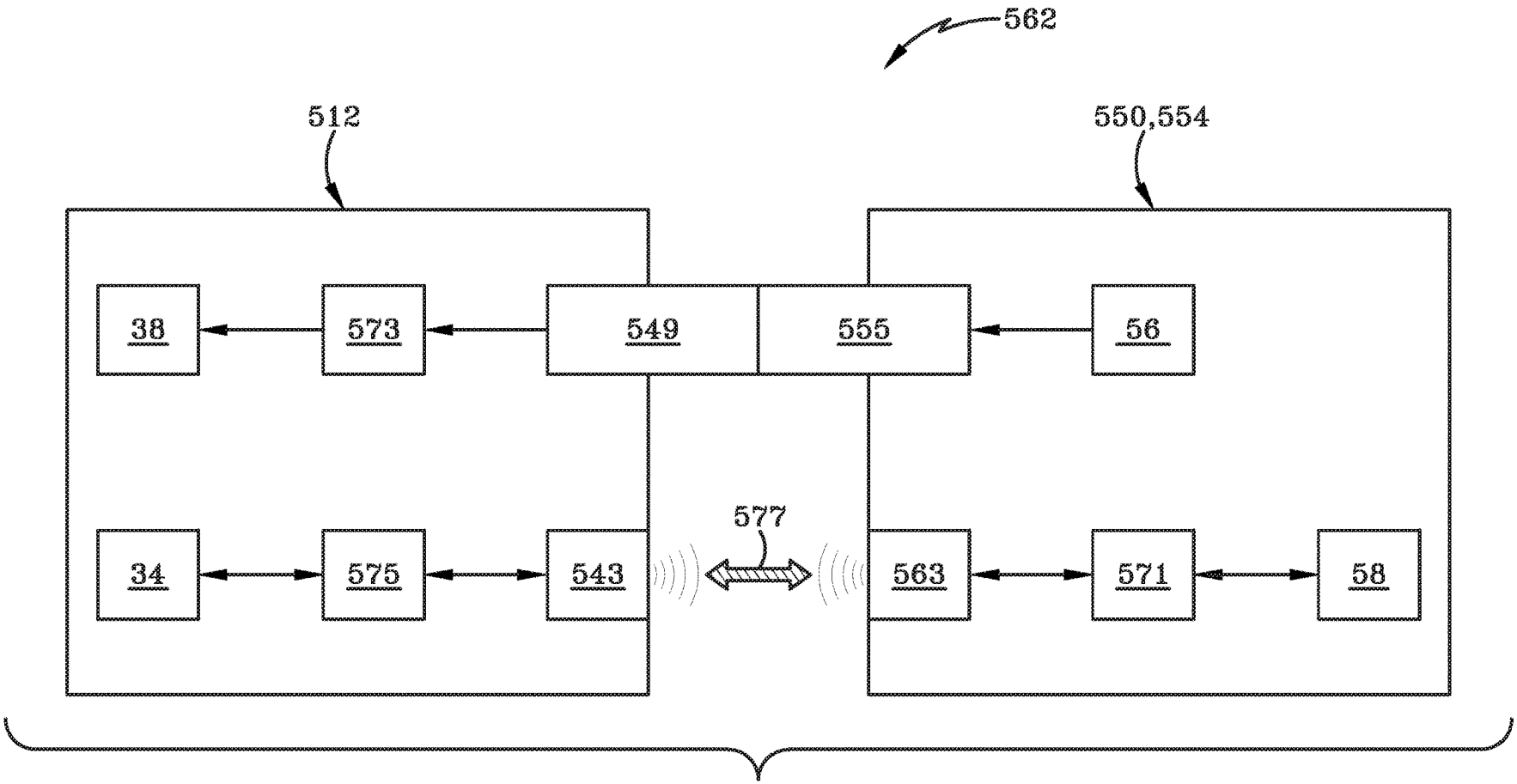
FIG. 11C is a flow chart showing a fourth method of providing high speed data and power to the guided projectile using the fuze setter.

FIGS. 11A to 11C show a seventh embodiment of a fuze setter interface in accordance with the present disclosure, generally indicated at 562 (FIG. 11B). In this seventh embodiment, fuze setter interface 562 is comprised of two independent interfaces, namely, an electric power interface 562*a* and a wireless RF communications interface 562*b*. Although a wireless RF communications interface is described, any of the wireless communications interfaces previously described herein, including optical communications, may be used. The electric power interface is a direct electrical connection that provides for efficient electrical power transfer between fuze setter 550 and fuze 512. This hard-wired, direct electrical connection between fuze setter 550 and fuze 512 is not wireless but does reduce electrical complexity within fuze 512 by eliminating power conditioning electronics that are required when utilizing an inductive approach. The hard-wired direct electrical connection also provides higher power transfer efficiency than the inductive approach, since losses through the inductive interface and associated power conditioning are avoided. As such, use of a direct electrical connection may avoid the complexities of inductive power transfer. The wireless RF communication is provided by a high speed RF interface 562*b* that enables bidirectional data communications between fuze setter and fuze.

FIG. 11A shows a leading end of a guided projectile 510 that includes a fuze 512 having a radome housing 522 engaged with a fuze body 524. Fuze body 524 is substantially identical to fuze body 24 and includes a sidewall 524*a* that bounds and defines an interior cavity 524*e*. The same components are located within the interior cavity 524*e* as are located in cavity 24*e*. Radome housing 522 is substantially identical to radome housing 22 in all aspects except radome housing 522 includes one or more recesses 522*g* defined in exterior surface 522*a*" of sidewall 522 and a contact pad 549 is provided in each recess 522*g*. In one example each recess 522*g* comprises an annular groove that extends circumferentially around exterior surface 522*a*" of radome housing 522. In one example, each contact pad 549 is an annular member that is seated within an annular groove 522*g*. In one example, a plurality of longitudinally spaced apart annular grooves 522*g* are defined in the exterior surface 522*a*" of sidewall 522*a* of radome housing 522, and an annular contact pad 549 is engaged in each of the annular grooves 522*g*. Each contact pad 549 may be a metallized pad that may be operatively engaged with fuze power supply 38 and other electrical components within fuze 512. It will be understood that use of annular contact pads is only one example. In principle, contact pads can be located in a variety of ways that ensure that the mating contacts on the fuze setter 550 are located in a compatible way to fuze 512, to ensure contact when the fuze 512 is mated to the fuze setter 550.

An annular electrical contact pad 549 is located within each of the one or more recesses 522*g*. Preferably, no part of the electrical contact pad 549 extends outwardly beyond the exterior surface 522*a*", although this may not be possible in all instances. Each electrical contact pad 549 may be operatively engaged with fuze power supply 38 and possibly with other components located within fuze 512. Electrical contact pads 549 are configured to be used for direct electrical power transfer between fuze setter 550 and fuze 522, as will be later described herein.

Radome housing 522 differs further from radome housing 22 in that an RF transceiver 543 is provided within cavity 522*d* instead of just the single induction coil 40. RF transceiver 543 is configured to be capable of high speed communications and is substantially identical in structure and function to RF transceiver 243 described earlier herein. RF transceiver 543 is shown as being positioned inwardly from and adjacent to the interior surface 522*b*' of front wall 522*b*. No part of the RF transceiver 543 extends through front wall 522*b* to the exterior surface 522*b*".

Fuze setter station 554 on fuze setter 550 may be substantially identical to fuze setter station 54 in all aspects except fuze setter station 554 may define one or more recesses 554*d* in sidewall 554*a* and an electrical power pin 555 may be operatively engaged in each of the one or more recesses 554*d*. The one or more recesses 554*d* are defined in sidewall 554*a* such as to be positioned in mating alignment with the one or more recesses 522*g* defined in sidewall of radome housing 522 when fuze 512 is inserted into port 554*c*. Each electrical power pin 555 may be a spring pin (e.g. a pogo pin) or any other configuration of spring contact that provides mechanical compliance and wiping action. When radome housing 522 is inserted into port 554*c*, recesses 554*d* on fuze setter 550 and recesses 522*g* on radome housing 522 will come into alignment and power pins 555 will come into direct electrical contact with contact pads 549. This is illustrated in FIG. 11B. When this situation occurs, electrical power may be directly transferred from fuze setter 550 to fuze 512.

Fuze setter station 554 further differs from fuze setter station 54 in that fuze setter station 554 includes an RF transceiver 563 that is not present in fuze setter station 54. RF transceiver 563 is positioned inwardly from and adjacent to an interior surface 554*b*' of front wall 554*b*. No part of RF transceiver 563 extends through front wall 554*b* to the exterior surface 554*b*" and into port 554*c*. RF transceiver 563 is configured to be capable of high speed data communications with RF transceiver 543 on fuze 512 when radome housing 522 is inserted into port 554*c*.

Referring to FIG. 11C, fuze setter 550, 554 includes a DC power source 56, a CPU 58, at least one electrical contact 555 (e.g. a power pin 555), an RF transceiver 563, and a signal generation function 571. Signal generation function 571 may be a function performed by the programming of CPU 58 or by another component designed specifically to perform these functions. Fuze 512 includes a microprocessor 34, a fuze power supply 38, at least one electrical contact pad 549, a power conditioning function 573, and a signal conditioning function 575. Power conditioning function 573 and signal conditioning function 575 may be functions performed by the programming of microprocessor 34 or by other components designed specifically to perform these functions.

Referring to FIG. 11C, fuze setter interface 562 is shown in greater detail. In the electrical power transfer, a fuze setter DC power source 56 delivers power to power pins 555. Power pins 555 are in directly physical communication with electrical contact pads 549 so power is delivered directly from power pins 555 to electrical contact pads 549. The power is then input to the power conditioning function 573 which performs any required functions such as filtering and voltage regulation to ensure the power is useable fuze power. In operation, the useable fuze power is applied as an input to fuze power supply 38, where the power is further conditioned, regulated, and distributed to the fuze electronics. One of the functions of fuze power supply 38 may be to store energy in a super-capacitor, to provide power to fuze memory for an extended period of time (typically 5 to 10 minutes) after the fuze setter 550 is disconnected from the fuze 512. Electrical power is thus transferred from fuze setter 550 to fuze 512 via the direct electrical coupling between pins 555 and electrical contact pads 549.

The data communication may operate in either a half-duplex or full-duplex mode. The description that follows applies to either of the half-duplex or full-duplex modes of operation. In fuze setter transmit (fuze receive) mode, fuze setter data is input from CPU 58 to signal conditioning function 571. Within the signal conditioning function 571, the data is processed into a form that is compatible with transmission via the RF transceiver 563. This processing may include filtering, amplification, level control, and modulation of an RF carrier frequency. The output from the signal conditioning function 571 is applied to the input of RF transceiver 563 which wirelessly transmits the data via an antenna provided on the RF transceiver 563 across the interface 562*b* (FIG. 11B). This wireless transmission is identified by the reference number 577 in FIG. 11C. In fuze setter receive (fuze transmit) mode, the RF signal transmitted 577 by RF transceiver 543 and received by the antenna of the RF communication transceiver 563 is applied to the signal conditioning function 571 where the data is extracted from the RF waveform. The extracted data may be stored or utilized by the CPU 58.

It will be understood with respect to the seventh embodiment fuze setter interface 562, that instead of using RF transceivers 543, 563 to provide high speed wireless communication, inductive or optical interfaces can be utilized to realize high speed wireless communication.

It will be further be understood that the direct-connect electrical power interface shown in FIGS. 11A-11C may be utilized in any of the fuze setter interfaces 62, 162, 262, 362, and 462 shown in FIGS. 5A through to 10C instead of the disclosed inductive electrical power interfaces.

When referring to any of the embodiments in accordance with the present disclosure, it should be understood that the terms "align", "alignment", "aligned", "rotational alignment", and "rotationally aligned", or any variant thereof, as used herein with respect to the electrical contacts that form the power interface between the fuze setter and the fuze represent a condition where the relative positions of the power interface contacts are sufficient to enable electrical power transfer across those interface contacts. In other words, the relative positions of the interface contacts is sufficient to allow power to be transferred from the fuze setter to the fuze.

In one example, components utilized to transfer one of power and data communication signals may be located adjacent to an interior surface of the sidewall of the fuze body instead of adjacent the interior surface of the radome housing. In one example, components utilized to transfer one of power and data communication signals may be located a distance inwardly away from the interior surface of the sidewall of the radome housing (or fuze body). The distance is sufficient to still permit the power or data communication signal to be transferred between the fuze and fuze setter. In one example, components utilized to transfer one of power and data communication signals may be at least partially located on the exterior surface of the sidewall of the radome housing (or fuze body).

All definitions, as defined and used herein, should be understood to control over dictionary definitions, definitions in documents incorporated by reference, and/or ordinary meanings of the defined terms.

"Guided projectile" may refer to any launched projectile such as rockets, mortars, missiles, cannon shells, shells, bullets and the like that are configured to have in-flight guidance. In some embodiments, the projectile body is a rocket that employs a precision guidance kit or fuze that is coupled to the rocket and thus becomes a guided projectile.

"Launch Assembly" or gun, as used herein, may refer to rifle or rifled barrels, machine gun barrels, shotgun barrels, howitzer barrels, cannon barrels, naval gun barrels, mortar tubes, rocket launcher tubes, grenade launcher tubes, pistol barrels, revolver barrels, chokes for any of the aforementioned barrels, and tubes for similar weapons systems, or any other launching device that may impart a spin to a munition round or other round launched therefrom. Launch assembly may also be on an aircraft, a helicopter, an unmanned aerial vehicle, or any other vehicle.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one computer-readable storage medium 24.

A computer utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer-readable storage medium (or multiple computer-readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer-readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments. Additionally, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

"Logic", if used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends well beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A system for programming and powering an artillery fuze comprising:

a fuze setter;

a fuze configured to be received in a port of the fuze setter;

a data communications interface formed between the fuze setter and fuze; and an electrical power interface formed between the fuze setter and the fuze, wherein the data communications interface and the electrical power interface are configured for substantially simultaneous operation.

2. The system according to claim 1, wherein the data communications interface utilizes one of inductive communications, wireless radio frequency communications, and optical communications.

3. The system according to claim 1, wherein one or both of the data communications interface and the electrical power interface is a fully wireless interface.

4. The system according to claim 1, wherein the electrical power interface is an inductively-coupled interface supporting electrical power transfer from the fuze setter to the fuze.

5. The system according to claim 1, wherein the electrical power interface is a direct-connect interface supporting electrical power transfer from the fuze setter to the fuze.

6. The system according to claim 1, wherein the electrical power interface and the data communications interface are independent interfaces that are physically separated from each other.

7. The system according to claim 1, wherein the data communications interface is comprised of:

a first communication member located entirely within an interior cavity of the fuze; and a second communication member located entirely within an interior cavity of the fuze setter; and when the fuze is received in the port, the fuze and fuze setter are in sufficiently close proximity for a wireless signal generated by one of the fuze and the fuze setter to be detected by the other of the fuze and the fuze setter.

8. The system according to claim 7, wherein the first communication member and the second communication member are capable of bidirectional communication.

9. The system according to claim 7, wherein both of the first communication member and the second communication member is one of an induction coil, a radio-frequency (RF) transceiver, and an optical transceiver.

10. The system according to claim 9, wherein both of the first communication member and the second communication member are RF transceivers, and the RF transceiver in the first communication member is a Height of Burst (HoB) sensor.

11. A fuze setter interface for transferring power and data between a fuze setter and a fuze comprising:

a fuze setter power inductor located within a fuze setter;

a fuze setter data communications member located within the fuze setter;

a fuze power inductor located within a fuze; and a fuze data communications member located within the fuze;

wherein the fuze setter power inductor and the fuze setter data communications member are located within the fuze setter adjacent to a port and will permit substantially simultaneous communication with the fuze power inductor and the fuze data communications member, respectively, when the fuze is inserted into the port.

12. The fuze setter interface according to claim 11, wherein both of the fuze setter data communications member and the fuze data communications member are one of an induction coil, a radio-frequency (RF) transceiver, and an optical transceiver.

13. The fuze setter interface according to claim 11, wherein the fuze setter power inductor and fuze power inductor form a wireless power interface; and the fuze setter data communications member and fuze data communications member form a wireless data communication interface; and the wireless power interface and wireless data communication interface operate essentially simultaneously.

14. A method of performing a fuze setting operation on a guided projectile prior to launch, said method comprising steps of:

inserting a leading end of a fuze of a guided projectile into a port of a fuze setter;

forming an electrical power interface between the fuze and the fuze setter;

forming a wireless data communications interface between the fuze and the fuze setter;

transferring electrical power from the fuze setter to the fuze utilizing the electrical power interface;

transferring data between the fuze and the fuze setter utilizing the data communications interface; and wherein the transferring of electrical power and the transferring of data occurs essentially simultaneously.

15. The method according to claim 14, wherein the transferring of electrical power and the transferring of data occurs wirelessly.

16. The method according to claim 14, wherein the forming of the electrical power interface comprises:

inputting current to an alternating current (AC) waveform generating function of the fuze setter;

generating an alternating current (AC) waveform with the AC waveform generating function;

inputting the generated AC waveform to a fuze setter power inductor;

generating a magnetic field with the fuze setter power inductor;

coupling to the magnetic field with a fuze power inductor;

generating an AC power waveform output in response to the coupled magnetic field;

inputting the AC power waveform output into a power conditioning function in the fuze; and converting the AC power waveform output to useable fuze power.

17. The method according to claim 14, wherein the forming of the data communications interface comprises forming a bidirectional data communications interface and using the bidirectional data communications interface to transmit data from the fuze setter to the fuze and to transmit data from the fuze to the fuze setter.

18. The method according to claim 14, wherein the forming of the data communications interface comprises:

inputting a data signal to a signal conditioning function of the fuze setter;

processing the input data signal to a form a transmission signal compatible with a fuze setter communication member;

transmitting the transmission signal from the fuze setter communication member to a fuze communication member;

demodulating the transmission signal;

extracting data from the demodulated transmission signal; and wherein the fuze utilizes the extracted data.

19. The method according to claim 18, wherein the step of processing the input data signal through to the step of demodulating of the transmission signal includes:

generating an alternating current (AC) waveform that is modulated by the data communicated across the data communications interface;

inputting the generated AC waveform to a fuze setter communications inductor;

generating a magnetic field with the fuze setter communications inductor;

coupling to the magnetic field with a fuze communications inductor;

generating an AC communications waveform output in response to the coupled magnetic field; and inputting the AC communications waveform into a signal conditioning function in the fuze that extracts the data.

20. The method according to claim 14, wherein the forming of the data communications interface includes:

inputting a fuze data signal to a signal conditioning function;

developing an AC waveform based on a frequency of a clock oscillator input;

modulating the developed AC waveform with the input fuze data signal;

applying the modulated AC waveform into a fuze signal inductor;

generating a magnetic field with the fuze signal inductor;

coupling the fuze signal inductor to a fuze setter inductor utilizing the generated magnetic field; and transferring data to the fuze setter via the magnetic field coupling.

* * * * *